US008915609B1

(12) United States Patent
Shah et al.

(10) Patent No.: US 8,915,609 B1
(45) Date of Patent: Dec. 23, 2014

(54) SYSTEMS, METHODS, AND DEVICES FOR PROVIDING A TRACK LIGHT AND PORTABLE LIGHT

(75) Inventors: Ashok Deepak Shah, Atlanta, GA (US); Kenneth George Beresinski, Fayetteville, GA (US); Christopher Michael Bryant, Social Circle, GA (US)

(73) Assignee: Cooper Technologies Company, Houston, TX (US)

( * ) Notice: Subject to any disclaimer, the term of this patent is extended or adjusted under 35 U.S.C. 154(b) by 116 days.

(21) Appl. No.: 13/441,491

(22) Filed: Apr. 6, 2012

Related U.S. Application Data

(63) Continuation-in-part of application No. 12/933,588, filed as application No. PCT/US2009/037840 on Mar. 20, 2009.

(60) Provisional application No. 61/472,536, filed on Apr. 6, 2011, provisional application No. 61/038,211, filed on Mar. 20, 2008.

(51) Int. Cl.
*F21L 4/00* (2006.01)
*F21L 13/00* (2006.01)

(52) U.S. Cl.
USPC ..... 362/183; 362/648

(58) Field of Classification Search
CPC ..... F21V 21/096; F21Y 2101/02; F21Y 2105/001; F21S 2/005; H05B 33/0803
USPC ..... 362/183, 398, 640, 647, 648; 439/38, 439/39, 40
See application file for complete search history.

(56) References Cited

U.S. PATENT DOCUMENTS

| | | | |
|---|---|---|---|
| 1,453,936 | A | 5/1923 | Gunn |
| 2,733,831 | A | 2/1956 | Nehls |
| 3,363,214 | A | 1/1968 | Wright |

(Continued)

FOREIGN PATENT DOCUMENTS

| | | |
|---|---|---|
| WO | WO 2005/104304 | 11/2005 |
| WO | WO 2009/117679 | 9/2009 |
| WO | WO 2009/117690 | 9/2009 |
| WO | WO 2009/117695 | 9/2009 |

OTHER PUBLICATIONS

U.S. Notice of Allowance dated Oct. 31, 2011 in U.S. Appl. No. 12/408,503.

(Continued)

*Primary Examiner* — Nimeshkumar Patel
*Assistant Examiner* — Glenn Zimmerman
(74) *Attorney, Agent, or Firm* — King & Spalding LLP

(57) ABSTRACT

A light module for use as a portable light or as a light source in a track lighting system is described herein. The light module may include a module housing containing a light emitting aperture, and a light emitting diode (LED) light source located inside the module housing, where the LED light source is aligned with the light emitting aperture. The light module further includes a driver electrically connected to the LED light source, and a chargeable power supply component electrically connected to the driver. The light module also includes at least two magnets attached to the exterior of the module housing, where at least one magnet is associated with a positive electrical terminal and another magnet is associated with a negative terminal, and where at least one magnet provides electrical power to at least one of the chargeable power supply component or driver.

21 Claims, 21 Drawing Sheets

(56) References Cited

U.S. PATENT DOCUMENTS 3,810,258 A * 5/1974 Mathauser ..... 439/39
4,005,380 A 1/1977 Heilmann et al.
4,153,936 A 5/1979 Schmitz et al.
4,180,744 A 12/1979 Helwig, Jr.
4,228,364 A 10/1980 Walden
4,325,223 A 4/1982 Cantley
4,347,576 A 8/1982 Kensinger et al.
4,370,723 A 1/1983 Huffman et al.
4,382,544 A 5/1983 Stewart
4,509,585 A 4/1985 Carney et al.
4,556,866 A 12/1985 Gorecki
4,663,569 A 5/1987 Alley et al.
4,695,738 A 9/1987 Wilmot
4,804,938 A 2/1989 Rouse et al.
4,847,782 A 7/1989 Brown, Jr. et al.
4,909,041 A 3/1990 Jones
5,154,509 A * 10/1992 Wulfman et al. ..... 362/648
5,248,919 A 9/1993 Hanna et al.
5,291,101 A 3/1994 Chandrasekaran
5,323,090 A 6/1994 Lestician
5,462,225 A 10/1995 Massara et al.
5,471,119 A 11/1995 Ranganath et al.
5,475,360 A 12/1995 Guidette et al.
5,621,662 A 4/1997 Humphries et al.
5,635,895 A 6/1997 Murr
5,668,446 A 9/1997 Baker
5,682,949 A 11/1997 Ratcliffe et al.
5,857,767 A 1/1999 Hochstein
5,884,205 A 3/1999 Elmore et al.
5,905,442 A 5/1999 Mosebrook et al.
5,924,486 A 7/1999 Ehlers et al.
5,927,598 A 7/1999 Broe
5,982,103 A 11/1999 Mosebrook et al.
6,016,038 A 1/2000 Mueller et al.
6,040,663 A 3/2000 Bucks et al.
6,059,582 A 5/2000 Tsai
6,089,884 A 7/2000 Klaus
6,157,093 A 12/2000 Giannopoulos et al.
6,178,362 B1 1/2001 Woolard et al.
6,184,656 B1 2/2001 Karunasiri et al.
6,216,956 B1 4/2001 Ehlers et al.
6,226,600 B1 5/2001 Rodenberg, III et al.
6,234,645 B1 5/2001 Borner et al.
6,244,733 B1 6/2001 Fong et al.
6,278,245 B1 8/2001 Li et al.
6,285,912 B1 9/2001 Ellison et al.
6,292,901 B1 9/2001 Lys et al.
6,304,464 B1 10/2001 Jacobs et al.
6,340,864 B1 1/2002 Wacyk
6,384,545 B1 5/2002 Lau
6,411,046 B1 6/2002 Muthu
6,441,558 B1 8/2002 Muthu et al.
6,441,723 B1 8/2002 Mansfield, Jr. et al.
6,445,139 B1 9/2002 Marshall et al.
6,459,919 B1 10/2002 Lys et al.
6,489,731 B1 12/2002 Bruning et al.
6,507,158 B1 1/2003 Wang
6,507,159 B2 1/2003 Muthu
6,528,594 B1 3/2003 Bauer et al.
6,548,967 B1 4/2003 Dowling et al.
6,552,495 B1 4/2003 Chang
6,576,881 B2 6/2003 Muthu et al.
6,577,512 B2 6/2003 Tripathi et al.
6,580,309 B2 6/2003 Jacobs et al.
6,586,890 B2 7/2003 Min et al.
6,596,977 B2 7/2003 Muthu et al.
6,598,991 B2 7/2003 Altman
6,608,453 B2 8/2003 Morgan et al.
6,614,013 B2 9/2003 Pitigoi-Aron et al.
6,621,235 B2 9/2003 Chang
6,630,801 B2 10/2003 Schuurmans
6,639,368 B2 10/2003 Sheoghong
6,720,745 B2 4/2004 Lys et al.
6,724,159 B2 4/2004 Gutta et al.
6,734,639 B2 5/2004 Chang et al.
6,741,351 B2 5/2004 Marshall et al.
6,777,891 B2 8/2004 Lys et al.
6,785,592 B1 8/2004 Smith et al.
6,788,541 B1 9/2004 Hsiung
6,796,680 B1 9/2004 Showers et al.
6,813,525 B2 11/2004 Reid et al.
6,831,569 B2 12/2004 Wang et al.
6,867,558 B2 3/2005 Gaus, Jr. et al.
6,874,691 B1 4/2005 Hildebrand et al.
6,888,819 B1 5/2005 Mushkin et al.
6,897,624 B2 5/2005 Lys et al.
6,901,521 B2 5/2005 Chauvel et al.
6,907,472 B2 6/2005 Mushkin et al.
6,933,685 B2 8/2005 Gutta et al.
6,937,648 B2 8/2005 Raphaeli
6,965,205 B2 11/2005 Piepgras et al.
6,975,079 B2 12/2005 Lys et al.
6,982,870 B2 1/2006 Wu et al.
6,998,594 B2 2/2006 Gaines et al.
7,014,336 B1 3/2006 Ducharme et al.
7,038,399 B2 5/2006 Lys et al.
7,071,762 B2 7/2006 Xu et al.
7,113,541 B1 9/2006 Lys et al.
7,132,804 B2 11/2006 Lys et al.
7,137,727 B2 * 11/2006 Joseph et al. ..... 362/648
7,139,617 B1 11/2006 Morgan et al.
7,140,752 B2 11/2006 Ashdown
7,161,313 B2 1/2007 Piepgras et al.
7,161,556 B2 1/2007 Morgan et al.
7,178,941 B2 2/2007 Roberge et al.
7,186,003 B2 3/2007 Dowling et al.
7,202,608 B2 4/2007 Robinson et al.
7,202,613 B2 4/2007 Morgan et al.
7,204,622 B2 4/2007 Dowling et al.
7,221,104 B2 5/2007 Lys et al.
7,231,060 B2 6/2007 Dowling et al.
7,233,115 B2 6/2007 Lys
7,233,515 B2 6/2007 Rohr
7,242,152 B2 7/2007 Dowling et al.
7,253,566 B2 8/2007 Lys et al.
7,255,457 B2 8/2007 Ducharme et al.
7,256,554 B2 8/2007 Lys
7,262,559 B2 8/2007 Tripathi et al.
7,264,515 B1 9/2007 Rubinstein
7,270,450 B2 9/2007 Chan
7,300,192 B2 11/2007 Mueller et al.
7,311,526 B2 12/2007 Rohrbach et al.
7,319,298 B2 1/2008 Jungwirth et al.
7,339,466 B2 3/2008 Mansfield et al.
7,344,279 B2 3/2008 Mueller et al.
7,344,379 B2 3/2008 Marmaropoulos et al.
7,353,071 B2 4/2008 Blackwell et al.
7,358,679 B2 4/2008 Lys et al.
7,358,681 B2 4/2008 Robinson et al.
7,358,706 B2 4/2008 Lys
7,358,961 B2 4/2008 Zwanenburg
7,387,405 B2 6/2008 Ducharme et al.
7,427,927 B2 9/2008 Borleske et al.
7,456,588 B2 11/2008 Alexandrov
7,467,948 B2 12/2008 Lindberg et al.
7,665,882 B1 * 2/2010 Wang ..... 362/650
7,703,951 B2 4/2010 Piepgras et al.
7,722,220 B2 5/2010 Van de Ven
7,725,629 B2 5/2010 Sturm et al.
7,726,974 B2 6/2010 Shah et al.
D620,634 S 7/2010 Komar et al.
7,766,518 B2 8/2010 Piepgras et al.
7,806,569 B2 10/2010 Sanroma et al.
7,813,131 B2 10/2010 Liang
7,878,678 B1 * 2/2011 Stamatatos et al. ..... 362/184
7,896,527 B2 3/2011 Chen
7,961,090 B2 6/2011 Hu
8,148,854 B2 4/2012 Shah et al.
2003/0199180 A1 10/2003 Koizumi et al.
2004/0033708 A1 * 2/2004 Joseph et al. ..... 439/110
2004/0137935 A1 7/2004 Zarom
2004/0178683 A1 9/2004 Hermetz et al.
2004/0259435 A1 12/2004 Stephan et al.
2005/0097162 A1 5/2005 Budike

(56) References Cited

U.S. PATENT DOCUMENTS

| | | | | |
|---|---|---|---|---|
| 2005/0201098 | A1 | 9/2005 | DiPenti et al. | |
| 2005/0289279 | A1 | 12/2005 | Fails et al. | |
| 2006/0022214 | A1 | 2/2006 | Morgan et al. | |
| 2006/0152945 | A1* | 7/2006 | Lantzsch et al. | 362/640 |
| 2006/0252284 | A1 | 11/2006 | Marmaropoulos et al. | |
| 2006/0262544 | A1 | 11/2006 | Piepgras et al. | |
| 2007/0024213 | A1 | 2/2007 | Shteynberg et al. | |
| 2007/0131784 | A1 | 6/2007 | Garozzo et al. | |
| 2007/0139921 | A1* | 6/2007 | Wu | 362/240 |
| 2007/0145915 | A1 | 6/2007 | Roberge et al. | |
| 2007/0213879 | A1 | 9/2007 | Iwamura | |
| 2007/0228999 | A1 | 10/2007 | Kit | |
| 2007/0229295 | A1 | 10/2007 | Curt et al. | |
| 2007/0253195 | A1 | 11/2007 | Dietz | |
| 2007/0260405 | A1 | 11/2007 | McConnell et al. | |
| 2007/0263393 | A1* | 11/2007 | Van De Ven | 362/362 |
| 2007/0287302 | A1* | 12/2007 | Lindberg et al. | 439/38 |
| 2009/0086478 | A1* | 4/2009 | Sanroma et al. | 362/234 |
| 2009/0086487 | A1 | 4/2009 | Ruud et al. | |
| 2009/0237011 | A1 | 9/2009 | Shah et al. | |
| 2009/0238252 | A1 | 9/2009 | Shah et al. | |
| 2009/0239393 | A1 | 9/2009 | Shah et al. | |
| 2009/0240380 | A1 | 9/2009 | Shah et al. | |
| 2009/0279298 | A1 | 11/2009 | Mier-Langner et al. | |
| 2010/0246201 | A1* | 9/2010 | Brendle et al. | 362/519 |
| 2010/0321937 | A1 | 12/2010 | Van Bommel et al. | |
| 2011/0019418 | A1* | 1/2011 | Sanroma et al. | 362/249.02 |
| 2011/0028006 | A1 | 2/2011 | Shah et al. | |
| 2011/0069508 | A1 | 3/2011 | Krijn et al. | |
| 2011/0204828 | A1* | 8/2011 | Moody et al. | 315/360 |
| 2012/0075857 | A1 | 3/2012 | Verbrugh | |

OTHER PUBLICATIONS

U.S. Official Action dated Dec. 7, 2010 in U.S. Appl. No. 12/408,503.
International Search Report and Written Opinion Apr. 29, 2009 in International Application No. PCT/US09/37859.
International Search Report and Written Opinion dated May 22, 2009 in International Application No. PCT/US09/37866.
International Search Report and Written Opinion dated May 27, 2009 in International Application No. PCT/US09/37843.
International Search Report and Written Opinion dated Jun. 4, 2009 in International Application No. PCT/US09/037840.
U.S. Official Action dated Jul. 22, 2009 in U.S. Appl. No. 12/408,464.
U.S. Notice of Allowance dated Jan. 11, 2010 in U.S. Appl. No. 12/408,464.
U.S. Official Action dated Jun. 9, 2011 in U.S. Appl. No. 12/408,503.
Renesas, "Renesas Board 10TM" Renesas Technology America, Inc., 2008, 2 pages.
Ramatchandirane et al., "Board 10—An Improved Approach to Achieving Robust Machineto-Machine Authentication that Reduces Operating Risks and Enables Profitable Business Strategies," White Paper, Renesas Technology America, Inc., Jul. 8, 2008, 5 pages.
Chinese Official Office Action dated Nov. 30, 2012 in Chinese Application No. 200980119572.9.
Chinese Official Office Action dated Jul. 16, 2013 in Chinese Application No. 200980119572.9.

* cited by examiner

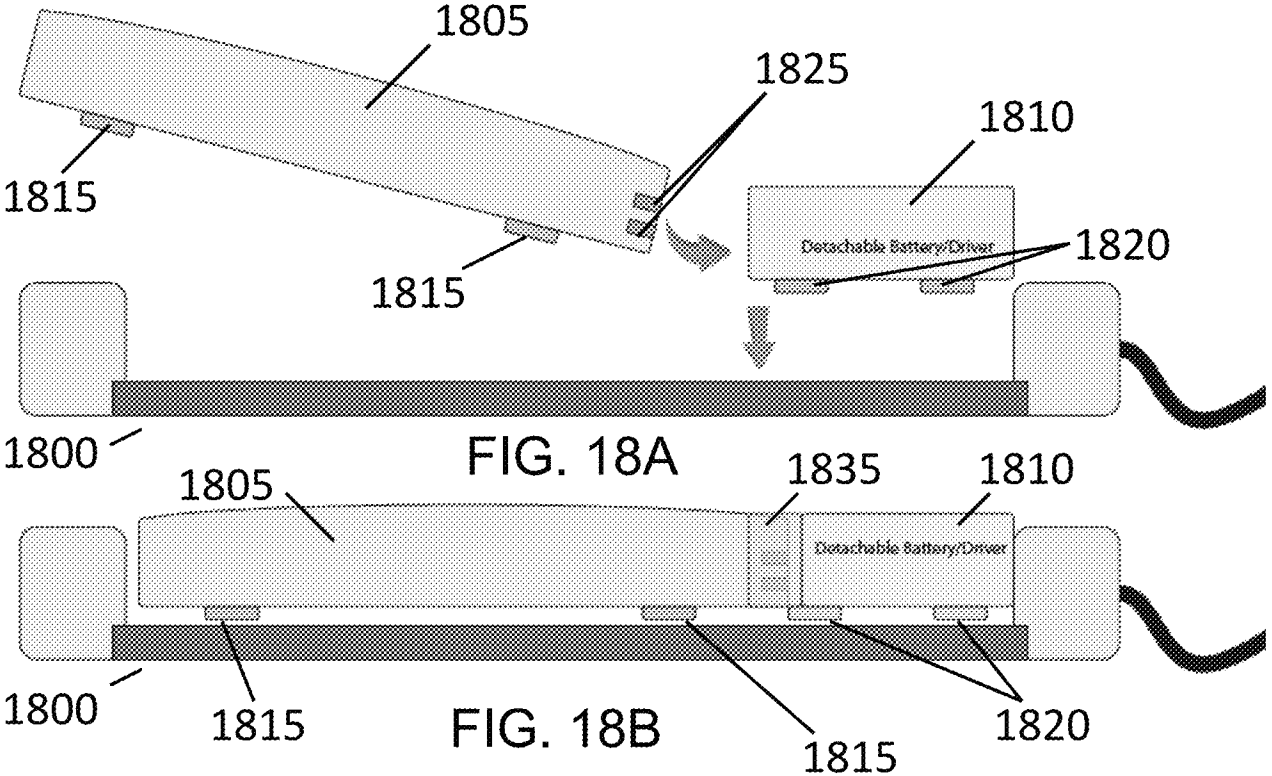
FIG. 18A
FIG. 18B
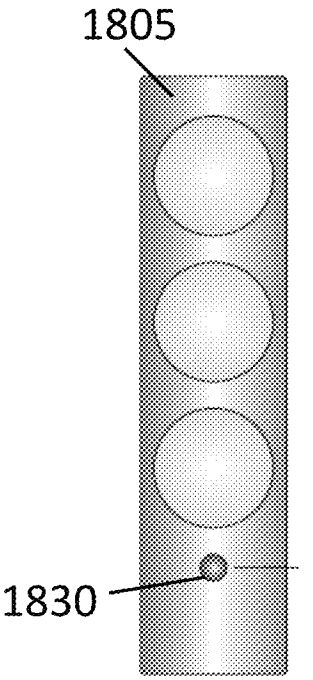
FIG. 18C

SYSTEMS, METHODS, AND DEVICES FOR PROVIDING A TRACK LIGHT AND PORTABLE LIGHT

RELATED APPLICATIONS

This application claims priority under 35 U.S.C. §119(e) to U.S. provisional patent application Ser. No. 61/472,536, titled "SYSTEMS, METHODS, AND DEVICES FOR PROVIDING A TRACK LIGHT AND PORTABLE LIGHT" filed on Apr. 6, 2011, which is expressly incorporated herein by reference. This application also is a continuation-in-part of and claims priority under 35 U.S.C. §120 to U.S. Non-provisional patent application Ser. No. 12/933,588, titled "CONDUCTIVE MAGNET COUPLING SYSTEM", filed Sep. 20, 2010, which in turn claims priority to international patent application Ser. No. PCT/US2009/037840, titled "CONDUCTIVE MAGNET COUPLING SYSTEM" filed on Mar. 20, 2009, which in turn claims priority under 35 U.S.C. §119 (e) to U.S. provisional patent application Ser. No. 61/038,211 titled "INTELLIGENT ILLUMINATION AND ENERGY MANAGEMENT SYSTEM" filed on Mar. 20, 2008. This patent application is also related to U.S. Pat. No. 8,148,854, titled "MANAGING SSL FIXTURES OVER PLC NETWORKS," and U.S. patent application Ser. No. 12/408,499, titled "ENERGY MANAGEMENT SYSTEM," and Ser. No. 12/408,463, titled "ILLUMINATION DEVICE AND FIXTURE," each of which was filed on Mar. 20, 2009. Each of the aforementioned patent applications listed above are expressly incorporated herein, in their entirety, by reference.

TECHNICAL FIELD

Embodiments of the invention relate generally to lighting solutions, and more particularly to systems, methods, and devices for providing light modules, such as a track light or portable light.

BACKGROUND

Advances in lighting technology has led to the replacement of various types of conventional light bulbs with light-emitting diodes (LEDs). The use of LEDs can reduce energy consumption and provide an increased life span, when compared with many conventional bulbs. For these reasons and others, LEDs are increasingly used in a wide range of applications, such as within automobiles, computers, and a large number of electronics.

However, LEDs have not historically been used in many home and business applications where conventional incandescent and fluorescent light bulbs are most commonly used. One of the reasons for this is cost. Traditional light bulbs are inexpensive and easily replaced. When a traditional bulb expires, it is easily removed from a base and replaced with a new bulb. However, due to their small size, LEDs are often mounted in an array on a circuit board and hard-wired into the particular application, such as within a traffic light or brake light fixture of an automobile. Replacing LED arrays typically involves replacing an entire fixture rather than a single "bulb," which can be cumbersome and expensive.

While fluorescent light technology has been adapted into a compact fluorescent lamp form in which a fluorescent light may be used with a conventional Edison screw base fitting, LED lighting is not as readily compatible with Edison screw base fittings. For example, dimming LEDs often involves utilizing pulse width modulation, which is difficult to perform using an Edison screw base. In addition to a modular and easily configurable LED lighting system, a modular coupling system that allows for the simplified removal, replacement, and reconfiguration of any electrical component that receives electricity and/or data would be desirable.

It is with respect to these and other considerations that the disclosure made herein is presented.

SUMMARY

It should be appreciated that this Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

According to an embodiment of the invention, there is disclosed a light module that includes a module housing containing a light emitting aperture, a light emitting diode (LED) light source located inside the module housing, where the LED light source is aligned with the light emitting aperture, a driver in electrically connected with the LED light source, a chargeable power supply component electrically connected with the driver. The light module further includes and at least two magnets attached to the exterior of the module housing, where at least one magnet is associated with a positive electrical terminal and another magnet is associated with a negative terminal, and where at least one magnet provides electrical power to at least one of the chargeable power supply components or the driver.

In accordance with one aspect of the invention, at least one magnet provides mechanical connection to a track system or charge station. According to another aspect of the invention, the light module may further include an inductive element for providing an electromagnetic force between the module housing and track system or charge station. In accordance with yet another embodiment of the invention, the housing includes a sensor. According to another aspect of the invention, the sensor is a capacitive touch sensor. In accordance with yet another embodiment of the invention, the LED light source is an organic LED light source.

According to another aspect of the invention, the light module may further include a power connector for charging the light module without use of the at least one magnet. In accordance with yet another embodiment of the invention, the chargeable power supply component or the driver is detachably coupled to the light module housing. According to another aspect of the invention, the chargeable power supply component or the driver is detachably coupled to the light module housing includes the at least one magnet when detached. In accordance with yet another embodiment of the invention, the light module may further include at least one optical element aligned with the light emitting aperture. According to another aspect of the invention, the light module may further include a pivot for rotating the light source, light emitting aperture, or the optical element.

In accordance with yet another embodiment of the invention, the light module may further include switching circuitry electrically connected to with the chargeable power supply component and driver, wherein the switching circuitry detects no power being supplied by the at least one magnet and engages the chargeable power supply component to supply power to the driver. According to another aspect of the invention, the housing includes an inductive element used create a stronger magnetic bond with a charging element or mechanical connection point for the light module.

Other systems, apparatuses, and methods according to embodiments will be or become apparent to one with skill in the art upon review of the following drawings and Detailed Description. It is intended that all such additional systems, apparatuses, and/or methods be included within this description, be within the scope of the present disclosure, and be protected by the accompanying claims.

BRIEF DESCRIPTION OF THE FIGURES

Reference will now be made to the accompanying drawings, which are not necessarily drawn to scale, and wherein:

FIGS. 18A and 18B illustrate a track lighting system with a portable light module and detachable power supply in accordance with one embodiment of the invention.

FIG. 18C is a top view of the portable light module shown in FIGS. 6A and 6B in accordance with one embodiment of the invention.

DETAILED DESCRIPTION

Figure 1:
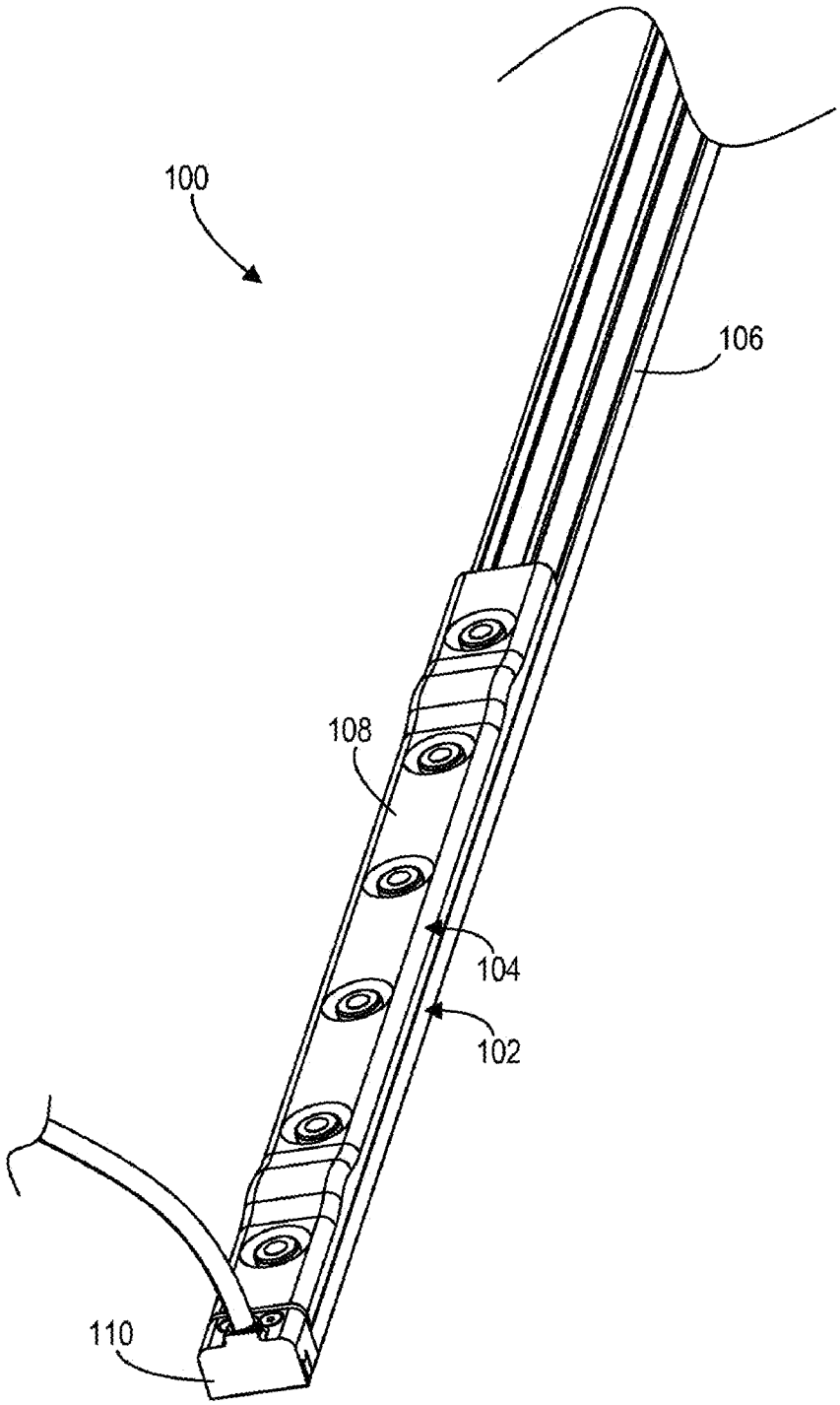
FIG. 1 is a perspective view of a conductive magnetic coupling system showing a power consumption component magnetically and electrically coupled to a power supply component according to various embodiments described herein.

The following detailed description is directed to conductive magnetic coupling systems. As discussed briefly above, due to the high efficiencies and superior life span of LED technology, LED lighting systems could offer long-term savings to general consumers and businesses if the systems were modular, allowing for the creation of LED "bulbs" that could be easily and relatively inexpensively replaced, rather than having to replace an entire fixture or LED unit.

Utilizing the technologies and concepts presented herein, a modular solid state luminary lighting solution, such as a LED lighting system, which may be additionally utilized as a modular coupling system for any other modular electronic components, provides a base power/data supply fixture to which an LED or other unit may be magnetically attached. Electrical and/or data signals are transferred directly through the magnetic connection to the attached receiving device. In addition, embodiments described herein provide an electronic coupling system that provides a user with increased flexibility over existing solutions. Using the embodiments described below, a user can position a light or other component at any location along a track system in a manner that is simplified over even existing track lighting systems. To change bulbs or reposition lighting, a user of the embodiments described herein simply pulls an existing component off of the track, which disengages the magnetic and electrical connections. To replace or move the component, the user simply places the desired component at a desired location on the track to engage the magnetic and electrical connections. There is no need to unscrew, twist, or otherwise disengage male and female components to do so, as is required to remove or replace existing light bulbs. Further, the conductive magnetic coupling systems described herein allow for the transfer of data, pulse width modulation operations, and other communication features to be utilized to control the operations and characteristics of the lighting components.

In the following detailed description, references are made to the accompanying drawings that form a part hereof, and which are shown by way of illustration, specific embodiments, or examples. Referring now to the drawings, in which like numerals represent like elements through the several figures, a conductive magnetic coupling system according to the various embodiments will be described. It should be understood that throughout this disclosure, the various embodiments are described in the context of an LED, or other solid state luminary, lighting system for illustrative purposes. However, the conductive magnetic coupling system described below is equally applicable to any other electronic component in which it would be desirable to detachably connect the component to a power and/or data source quickly and easily via a magnetic connection. Accordingly, the disclosure presented herein is not limited to use with LED or other luminary components.

Turning now to FIG. 1, one embodiment of a conductive magnetic coupling system 100 will be described. With this embodiment and all others described herein, the coupling system 100 includes a power supply component 102 that supplies an electrical signal and/or a data signal to a power consumption component 104, which is magnetically connected to the power supply component 102. The power consumption component 104 transforms the electrical and/or data signal to perform a function, such as illuminating an LED strip or array. Various configurations of power supply components 102 and power consumption components 104 will be described herein according to various embodiments. According to the embodiments shown in FIGS. 1-8, the power supply component 102 includes a track system 106 and the power consumption component 104 includes a LED light strip 108. The LED light strip 108 is magnetically secured to the track system 106 for receiving power and/or data. The conductive magnetic coupling system 100 may be powered and managed using a power and control module 110, which is described in further detail below with respect to FIG. 8.

According to various embodiments, the track system 106 may include tracks of any length that are configured to magnetically couple to any number of corresponding LED light strips 108. While the LED light strip 108 is shown to abut an end of the track system 106, the LED light strip 108 may be placed at any position along the length of the track system 106 not occupied by another LED light strip 108. Similarly, any number of LED light strips 108 may be positioned on the track system 106 such that they abut one another or with any amount of space left between the mounted LED light strips 108. As will become clear from the disclosure herein, the magnetic mechanism for binding the power consumption components 104 to the power supply components 102 allows repositioning of the LED light strips 108 or other components by simply pulling the LED light strip 108 off of the track system 106 and replacing the LED light strip 108 in the desired position, or more quickly, by sliding the LED light strip 108 down the tracks to the desired position on the track system 106.

Looking at FIG. 2, each component of the conductive magnetic coupling system 100 will now be described. According to each embodiment described herein, the power consumption component 104 includes a power receiving coupling mechanism 204 and a power consumption device 202. The power receiving coupling mechanism 204 operates to attach the power consumption component 104 to the power supply component 102 and to transfer electrical and/or data signals between the power supply component 102 and the power consumption device 202. The power consumption device 202 includes the light assembly or other electronic device that is using the electricity to perform a function, such as producing light.

Similarly, the power supply component 102 includes a power distribution coupling mechanism 208 that attaches to the power receiving coupling mechanism 204 to supply power and/or data to the power consumption device 202 from the power and control module 108. According to various embodiments presented herein, the power distribution coupling mechanism 208 and the power receiving coupling mechanism 204 may both be conductive magnets, or one may include conductive magnets while the other includes a metal or other material that is attracted to a magnet and has conductive properties that allows for the transfer of an electrical and/or data signal. Alternatively, the power distribution coupling mechanism 208 may include magnetic coupling mechanisms and separate power leads, while the power receiving coupling mechanism includes magnetic coupling mechanisms and separate power leads such that the magnetic coupling mechanisms of the two components bond them together while the power leads transfer electronic and data signals.

Figure 2:
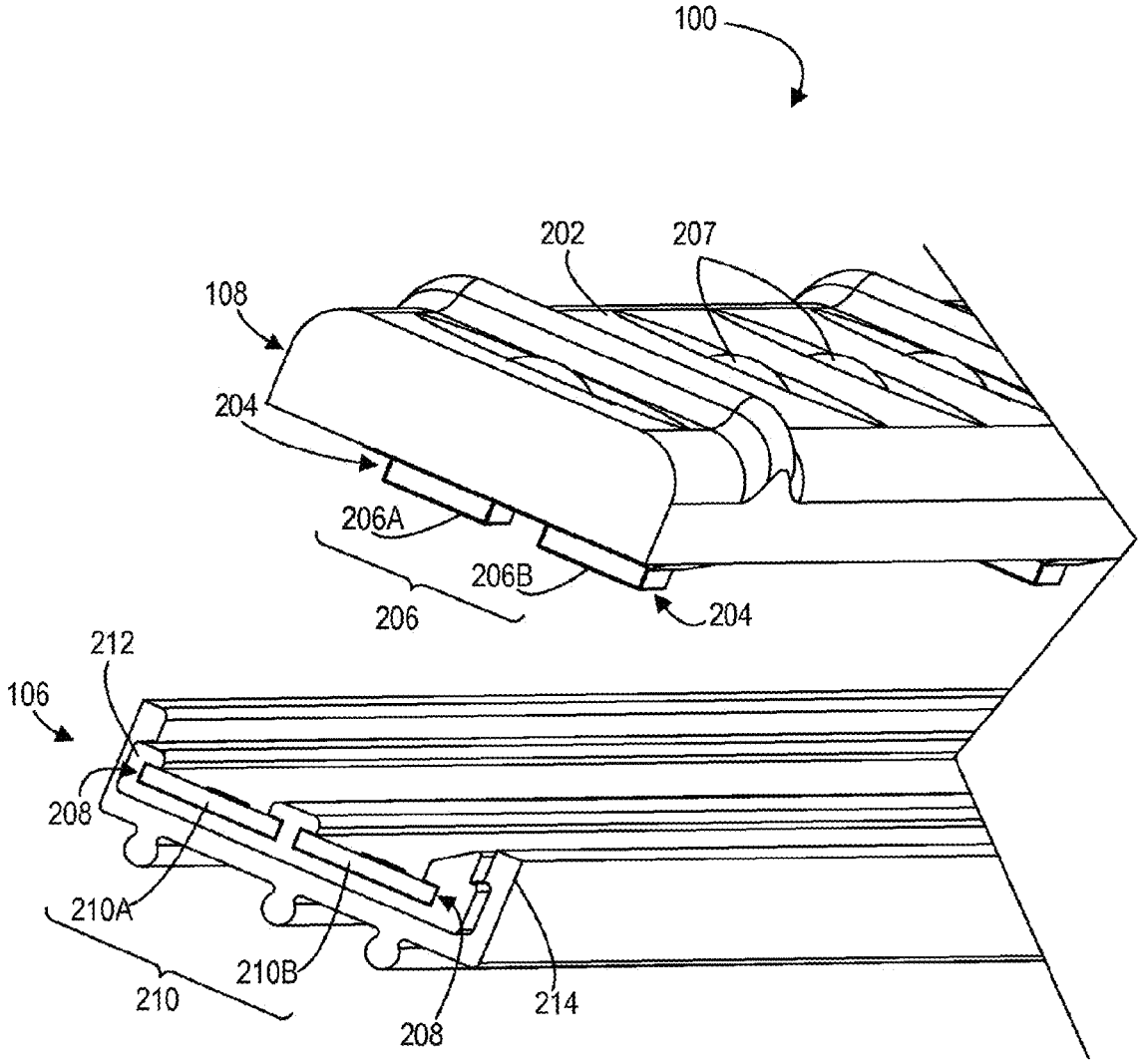
FIG. 2 is a perspective view of the conductive magnetic coupling system of FIG. 1 showing the power consumption component magnetically and electrically decoupled from the power supply component according to various embodiments described herein.

According to the configuration of the conductive magnetic coupling system 100 shown in FIG. 2, the power consumption component 104 includes the LED light strip 108. Conductive magnets 206 function as the power receiving coupling mechanism 204 for receiving power and/or data from the track system 106. Various examples of conductive magnets 206 will be shown and described below with respect to FIGS. 3-5. The power consumption device 202 includes a number of LED assemblies 207 and associated circuitry. Although the LED light strip 108 is shown to include a number of LED assemblies 207 arranged in a linear configuration, it should be understood that any configuration of LED assemblies 207 may be used such that any number of LED assemblies 207 may be arranged in an array of any size and shape within the scope of this disclosure.

According to the configuration shown in FIG. 2, the power supply component 102 includes a track system 106 having two tracks 210 that are also conductive magnets. It should be understood that the track system 106 is not limited to the use of two tracks 210. As will be discussed below with respect to FIG. 8, additional tracks 210 may be used for communication and control between the power supply component 102 and the power consumption component 104 via the power and control module 110. The power supply component 102 may further include a track holder 212 for securing the tracks 210 within a base 214. It should be appreciated that the power supply component 102 is not limited to the configuration shown and that any number and configuration of components may be utilized to support the tracks 210 that are operative to connect with the power receiving coupling mechanism 204 and to supply power and/or data to the power receiving coupling mechanism 204.

As previously mentioned, there are several alternative embodiments for magnetically securing the LED light strip 108 to the track system 106. First, as described above, both the power receiving coupling mechanism 204 and the power distribution coupling mechanism 208, or tracks 210 in the embodiment described here, may be conductive magnets 206. In this embodiment, the polarity of the conductive magnets 206 are aligned such that the exposed pole of the conductive magnet 206A is the same as the conductive magnet track 210B, but opposite of the conductive magnet 206B and of the conductive magnet track 210A. In this manner, the conductive magnetic coupling system 100 limits the attachment of the LED light strip 108 to the track system 106 to a single orientation that to properly route direct current (DC) through the LED assemblies 207.

For example, in the conductive magnetic coupling system 100 shown in FIG. 2, assume that conductive magnet 206A and conductive magnet track 210B are configured as having exposed north poles, while conductive magnet 206B and conductive magnet track 210A are configured with an exposed south pole. The north pole of conductive magnet 206A is attracted to the south pole of conductive magnet track 210A, but repels the north pole of conductive magnet track 210B. Similarly, the south pole of conductive magnet 206B is attracted to the north pole of conductive magnet track 210B, but repels the north pole of conductive magnet tack 210A. In this manner, the LED light strip 108 can only be connected to the track system 106 in the orientation shown. If the LED light strip 108 is rotated 180 degrees, then the magnets 206B and 210A would repel one another, as would magnets 206A and 210B.

An alternative embodiment for magnetically securing the LED light strip 108 to the track system 106 includes using conductive magnets on either the power supply component 102 or the power consumption component 104, and then using a conductive material such as steel or other metal that is attracted to a magnet on the other component. For example, looking at FIG. 2, the power receiving coupling mechanism 204 may include conductive magnets 206A and 206B, while the power distribution coupling mechanism 208 includes steel tracks 210A and 210B. In this embodiment, the conductive magnets 206A and 206B are attracted to the steel tracks 210A and 210B, respectively, and electrical signals and data signals can be transferred between the steel tracks 210A and 210B and the LED assemblies 207 through the conductive magnets 206A and 206B. Similarly, in yet another alternative embodiment, the power receiving coupling mechanism 204 may include steel or another conductive material that is attracted to the power distribution coupling mechanism 208, which includes conductive magnet tracks 210A and 210B.

Figure 3:
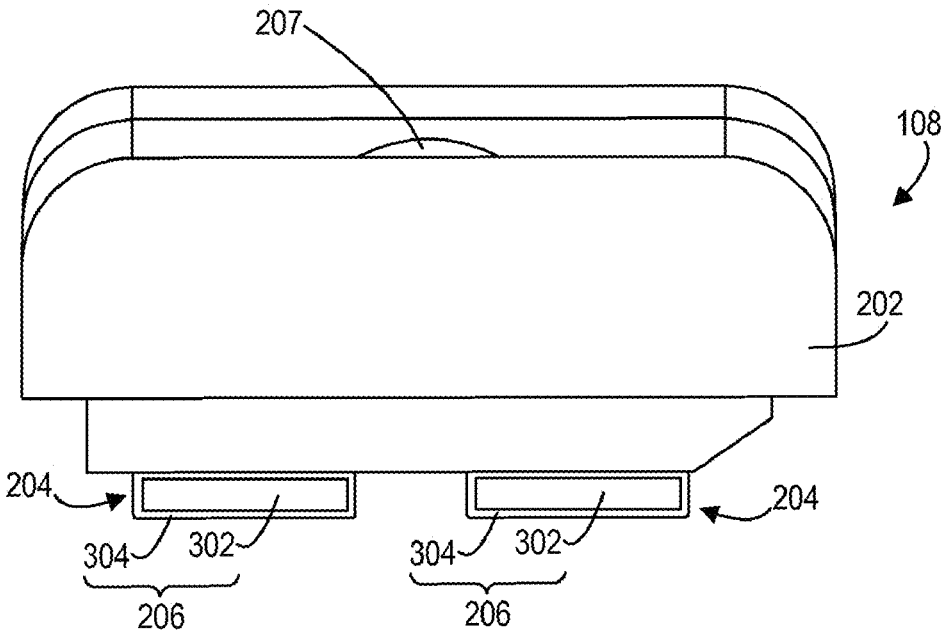
FIG. 3 is a cross-sectional view of a power consumption component showing an electrically conductive magnet in which a magnet is coated with a conductive material according to various embodiments described herein.
Figure 4:
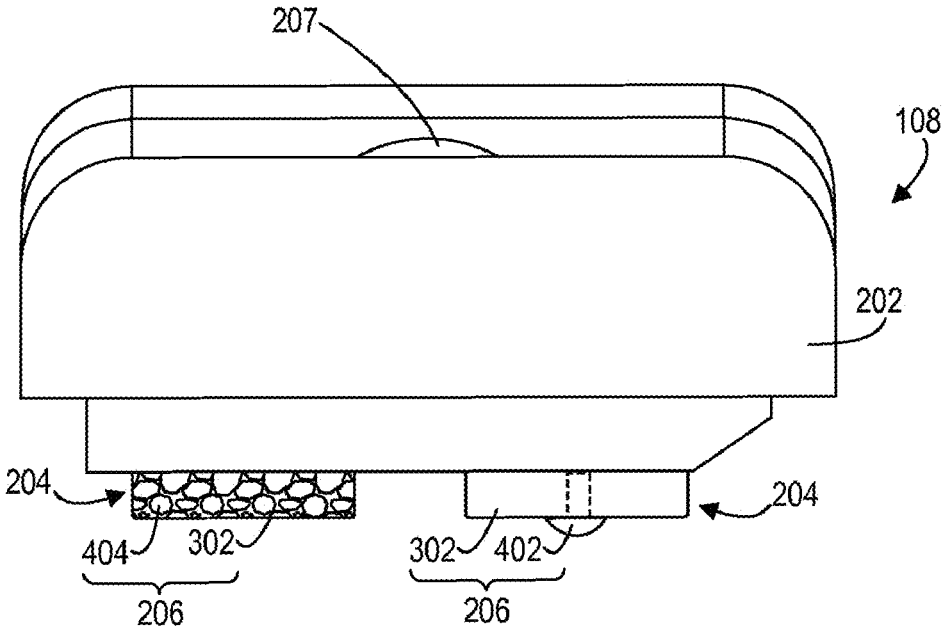
FIG. 4 is a cross-sectional view of alternative embodiments of an electrically conductive magnet in which a magnet includes a conductive fastener and in which a magnet is impregnated with a conductive material to provide conductive paths through the magnets to the power consumption device according to various embodiments described herein.
Figure 5:
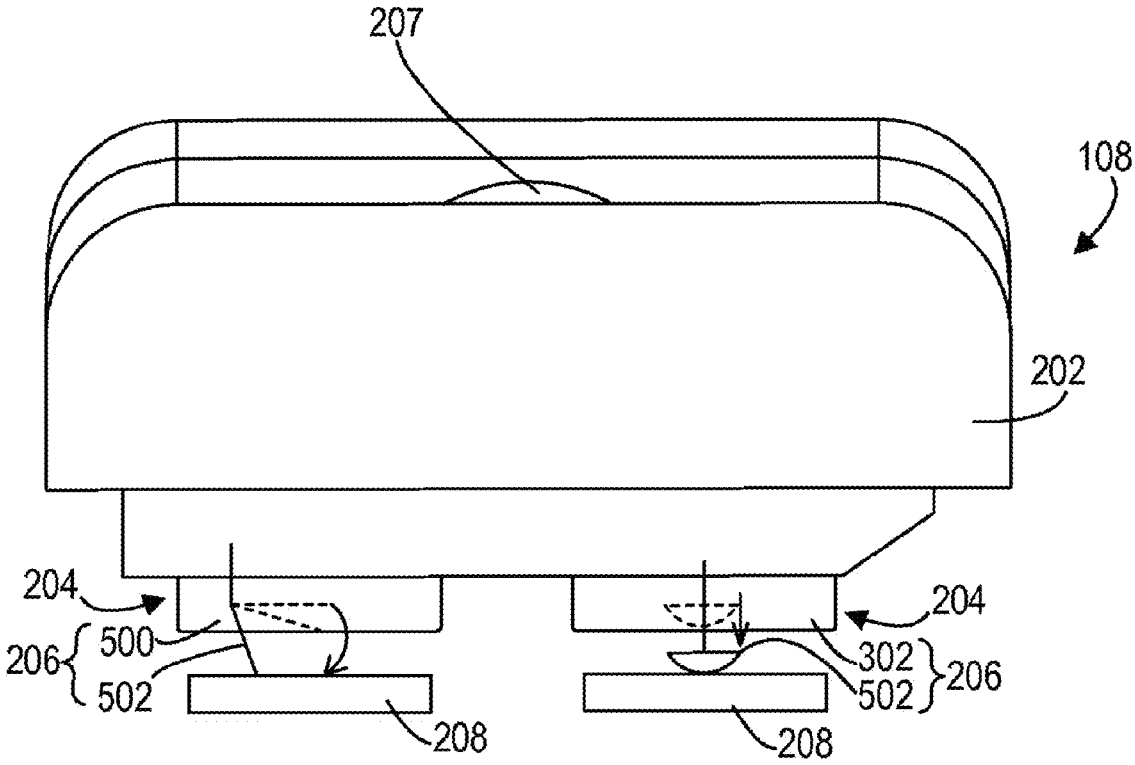
FIG. 5 is a cross-sectional view of an alternative embodiment of an electrically conductive magnet that includes a retractable conductive magnetic contact that extends from a magnet cover to provide a conductive path to the power consumption device according to various embodiments described herein.

Turning now to FIGS. 3-5, cross-sectional views of the LED light strip 108 will be discussed to illustrate various embodiments for providing a conductive magnet 206. According to the embodiment shown in FIG. 3, the power receiving coupling mechanism 204 includes two conductive magnets 206. It should be appreciated that any number of conductive magnets 206 may be used without departing from the scope of this disclosure. Each conductive magnet 206 includes a magnet 302 and a conductive coating 304. The magnet 302 may be a rare earth magnet, a permanent magnet, a ceramic magnet, an electromagnet, or any other type of magnetic material. The strength of the magnets should be sufficient to ensure a connection of the power supply component 102 and the power consumption component 104 that will support the weight of the power consumption component 104 if the conductive magnetic coupling system 100 is mounted on a wall or ceiling, while allowing for removal of the power consumption components 104 without requiring a person to use excessive force to break the magnetic connection. According to one embodiment, the magnet 302 is a neodymium magnet.

The conductive coating 304 encompassing the magnet 302 can be any conductive material of sufficient thickness that will not interfere with the magnetic connection of the magnet 302 and that will properly provide a conductive path for routine an electrical signal and/or a data signal between the power distribution coupling mechanism 208 and the power consumption device 202. According to one embodiment, the conductive coating is a nickel coating. It should be appreciated that the conductive coating 304 may completely encompass the magnet 302 so that none of the magnet 302 is exposed, or it may only partially encompass the magnet 302 while providing a conductive path around and/or through the magnet 302. The conductive coating 304 is electrically connected to the circuitry within the power consumption device 202 for operating the LED assemblies 207.

FIG. 4 illustrates two alternative embodiments of the conductive magnets 204. The first alternative embodiment utilizes conductive magnets 204 that include a magnet 302 and a conductive fastener 402. Rather than utilizing a conductive coating 304 to provide a conductive path between the power distribution coupling mechanism 208 and the power consumption device 202, this configuration provides for a conductive fastener 402 used to secure the magnet 302 to the consumption device 202 and to provide for the conductive path for routing electrical and/or data signals. As an example, the conductive fastener 402 may be a rivet that when installed, has an exposed head that contacts the tracks 210 or other power distribution coupling mechanism 208. The side of the rivet that is opposite the head is connected to the circuitry within the power consumption device 202 to power and route data to and from the LED assemblies 207.

The second alternative embodiment shown in FIG. 4 utilizes conductive magnets 204 in which the conductive magnets 204 are impregnated with a conductive material 404 of sufficient density that allows the magnet 302 to provide the conductive path for the electrical and/or data signals passing between the power distribution coupling mechanism 208 and the power consumption device 202. In this embodiment, a conductive coating 304 or a conductive fastener 402 is not utilized since the magnet itself allows for electrical continuity between the tracks 210 and the circuitry within the LED light strip 108.

FIG. 5 shows yet another alternative embodiment in which the conductive magnet 206 includes a magnet cover 500 with a retractable conductive magnetic contact 502 embedded within. The retractable conductive magnetic contact 502 is biased in a retracted position recessed within the magnet cover 500. When exposed to a magnetic field of a conductive magnetic track 210A or 210B, or of any other magnetic power distribution coupling mechanism 208, the retractable conductive magnetic contact 502 is configured to extend from the magnet cover 500 until contact is made with the power distribution coupling mechanism 208 to provide a conductive path to the power consumption device 202 for an electrical and/or data signal. The retractable conductive magnetic contact 502 may include a magnet 302 with a conductive coating 304 or a magnet 302 that is impregnated with a conductive material 404, as described above.

FIG. 5 shows two embodiments in which the retractable conductive magnetic contact 502 extends from the magnet cover 500. In the first, the retractable conductive magnetic contact 502 rotates out of the magnet cover 500 to contact the magnetic power distribution coupling mechanism 208. In the second, the retractable conductive magnetic contact 502 extends axially downward out of the magnet cover 500 to contact the magnetic power distribution coupling mechanism 208. In both embodiments, the retractable conductive magnetic contact 502 maintains contiguous contact with a conductive component connected to the circuitry within the power consumption device 202.

It should be clear from this description of the conductive magnets 204 that each magnet 302 and the corresponding conductive coating 304, conductive fastener 402, and/or impregnated conductive material 404 of the various embodiments form a single, bonded component that functions both as a binding mechanism and a conductive mechanism for magnetically and communicatively coupling the power consumption component 104 to the power supply components 102 of the conductive magnetic coupling system 100. This differs from any conventional use of magnets used to bond electrical components in which a magnet is used to hold components together in a position that allows electrical pins to align on the components to be attached. In a conventional application, the magnets and the electrical contacts are separate entities. The electrical contacts on the mating components must align and be held in place, which is accomplished using a magnet. In contrast, the conductive magnets 204 serve as both the bonding agent and the electrical contact. They may be positioned anywhere along the power distribution coupling mechanism 208 since there are no pins or contacts that require alignment. Rather, the electrical and/or data signals traverse the tracks 210 to any location in which the conductive magnets 204 are attached.

Figure 6:
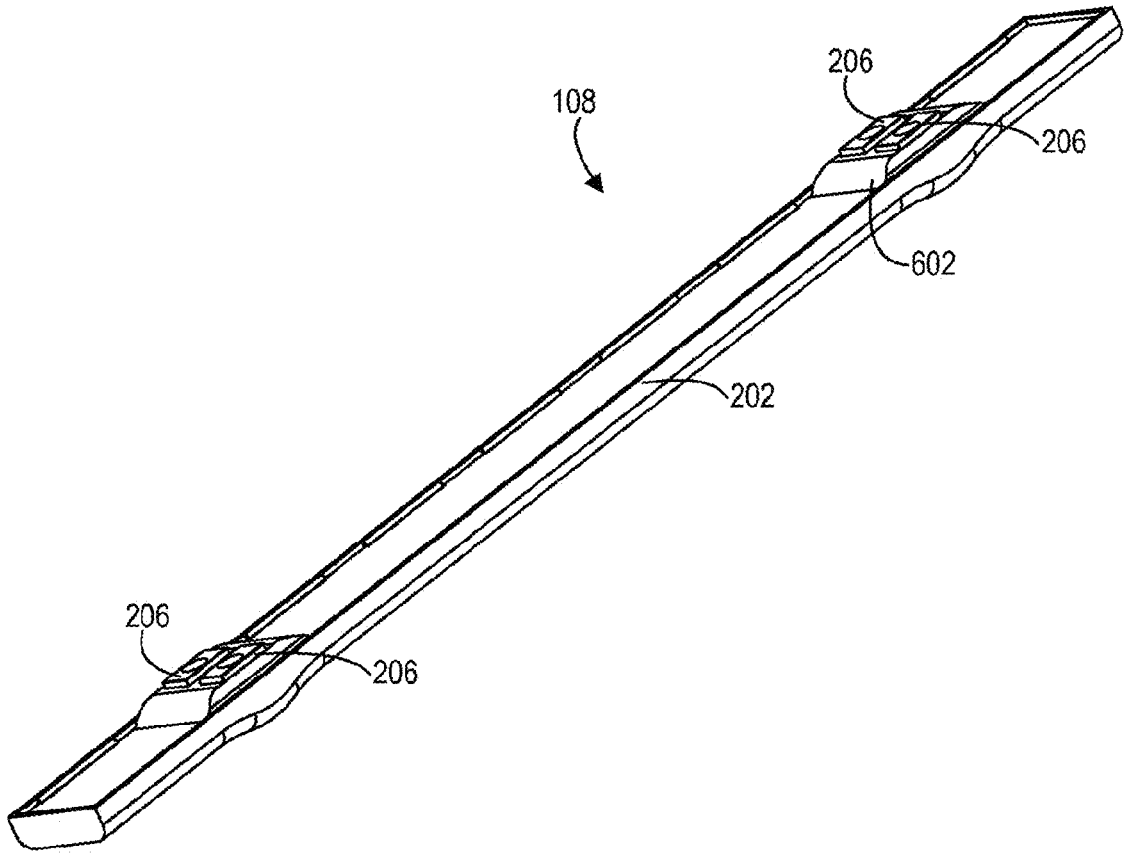
FIG. 6 is a perspective view of a bottom side of a power consumption component showing electrically conductive magnets for coupling and receiving an electrical signal according to various embodiments described herein.
Figure 7:
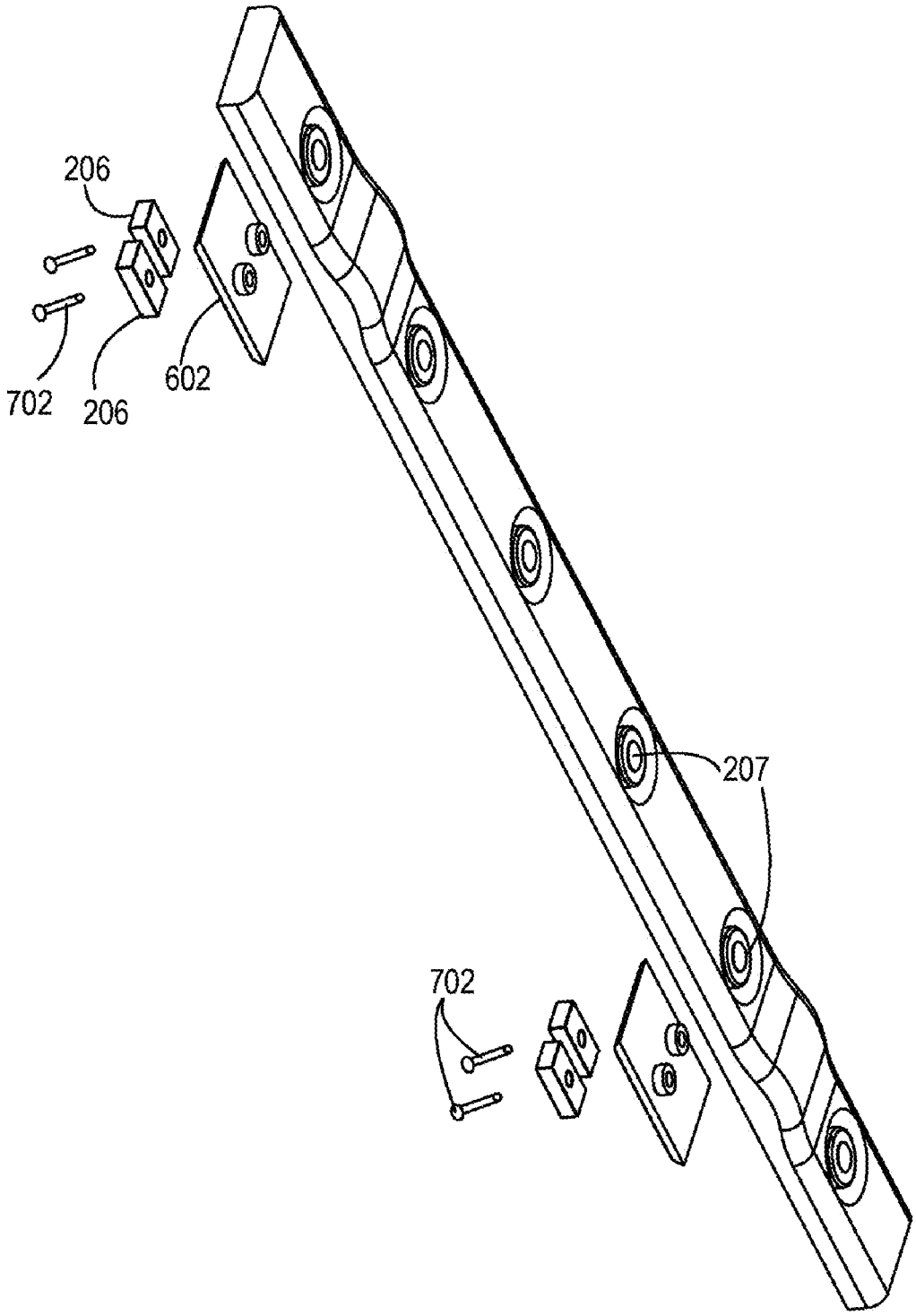
FIG. 7 is an exploded view of the power consumption component of FIG. 6 according to various embodiments described herein.

Turning now to FIGS. 6 and 7, perspective bottom and exploded views, respectively, illustrate the various components of a LED light strip 108 according to embodiments of the disclosure presented herein. The LED light strip 108 includes a number of LED assemblies 207 electrically connected to two sets of conductive magnets 206. While the LED light strip 108 is shown to include two sets of adjacent conductive magnets 206, it should be appreciated that any number of conductive magnets 206 may be used. According to one embodiment, approximately half of the LED assemblies 207 are provided with electrical and/or data signals via one pair of conductive magnets 206, while the second pair of conductive magnets routes power and/or data signals to and from the other half of the LED assemblies. According to another embodiment, each conductive magnet 206 that is configured to connect to the same track 210 provides electrical and/or data signals to the same pole of the circuit within the power consumption device 202 containing the LED assemblies 207.

Magnet spacers 602 are used to elevate the power consumption device 202 with respect to the conductive magnets 206 to create an air gap between the LED light strip 108 and the tracks 210. This air gap assists in the thermal management of the power consumption device 202. Similarly, the conductive magnets 206 operate as a heat sink to route heat from the LED assemblies 207 to the tracks 210. The air gap may additionally prevent any short circuit situations with respect to conductive contact with the tracks 210. As seen in FIG. 7, rivets 702 or other fasteners may be used to secure the power consumption device 202, the magnet spacers 602, and the conductive magnets 206 together. Alternatively, any other bonding means such as adhesive and various welding techniques may be used.

Figure 8:
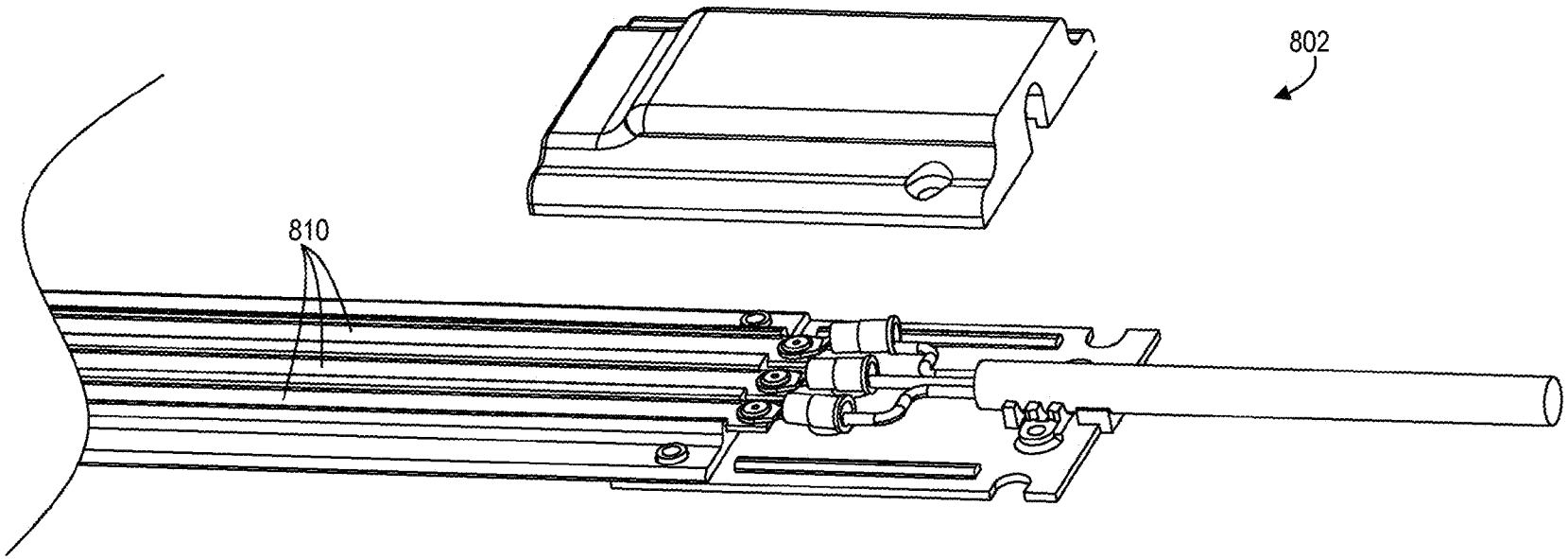
FIG. 8 is a partially exploded perspective view of a 3-channel conductive magnetic coupling system according to various embodiments described herein.

FIG. 8 shows a track system 802 in which the power supply component 102 includes three tracks 810, instead of the two tracks 210 described above. By utilizing a third track 810, a data channel may be included in addition to the two electrical channels. This third channel facilitates modulation operations with the LED light strip 108. Various modulation techniques, including, but not limited to, pulse-width modulation, pulse-shape modulation, pulse code modulation, parallel pulse code modulation, and bit angle modulation techniques may be used to control the dimming of the LED assemblies 207.

Moreover, data may be transmitted between the power and control module 110 and the LED assemblies 207 to create an intelligent lighting system that optimizes light output according to any number of LED and environmental parameters. The power and control module 110 may include all the microprocessors and other components that drive the intelligent lighting systems. By modularizing this controller in a similar manner as the power consumption component 104, the power and control module 110 may be easily replaced to fix a damaged module or to modify the capabilities of the power and control module 110. The pulse width modulation operations and intelligent lighting system are described in the co-pending patent applications referenced above and entitled, "MANAGING SSL FIXTURES OVER PLC NETWORKS," "ENERGY MANAGEMENT SYSTEM," and "ILLUMINATION DEVICE AND FIXTURE," each of which is expressly incorporated by reference herein in its entirety.

Figure 9:
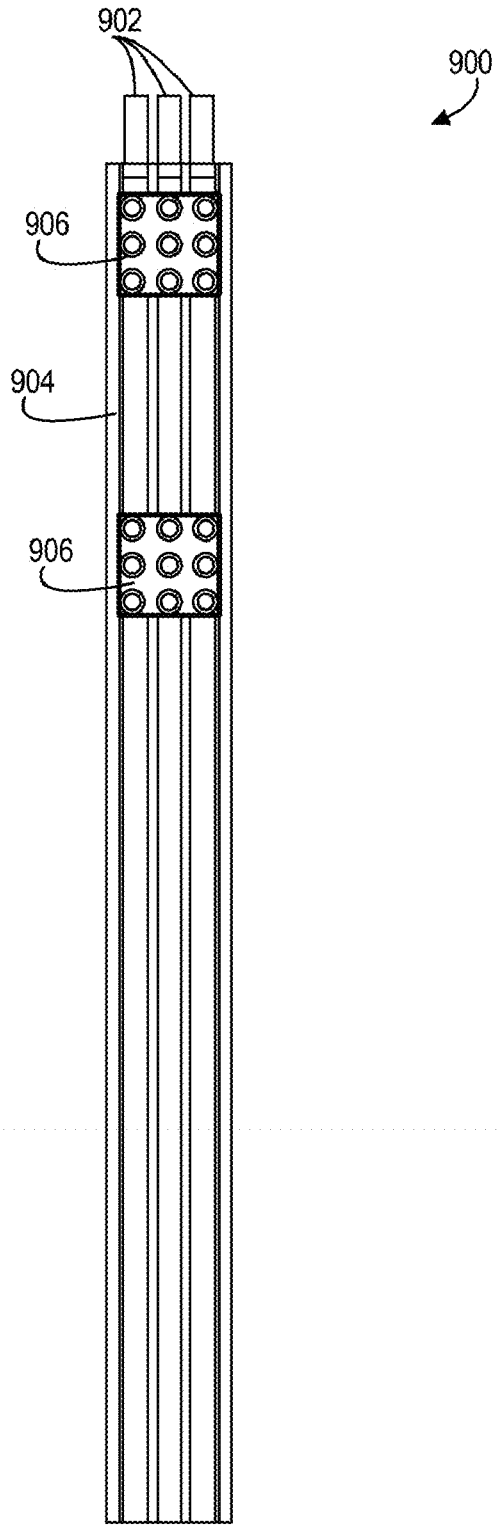
FIG. 9 is a plan view of a conductive magnetic coupling system showing power consumption components coupled to a flexible insulator encompassing a number of parallel electrical conductors according to various embodiments described herein.
Figure 10:
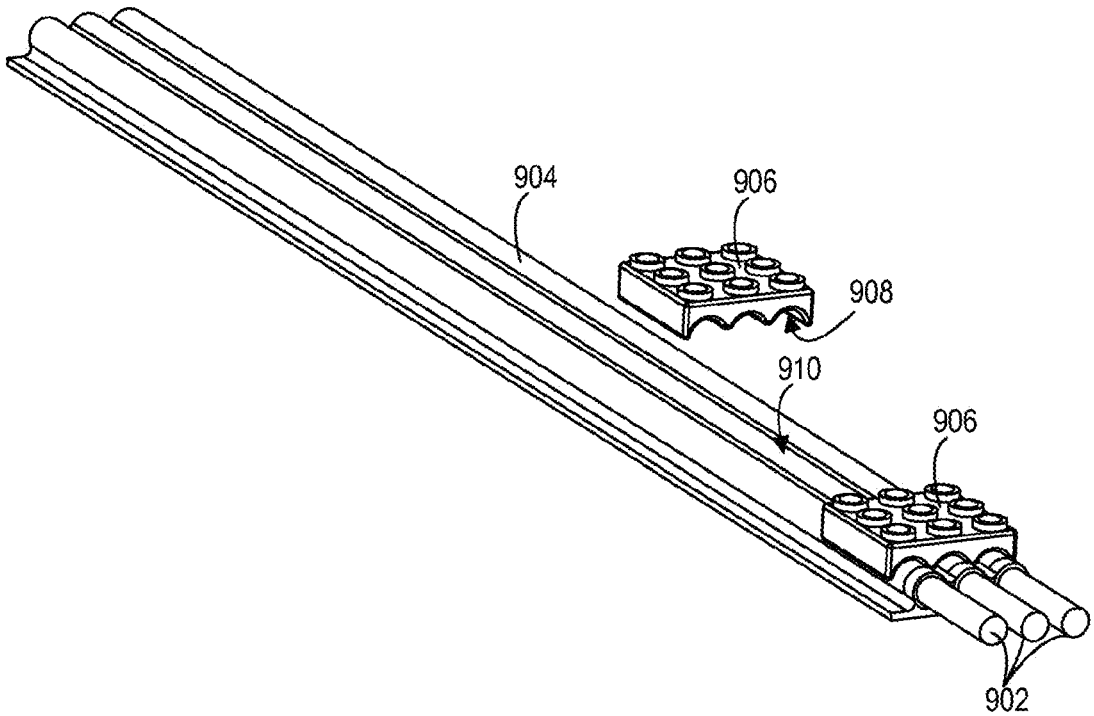
FIG. 10 is a partially exploded perspective view of the conductive magnetic coupling system of FIG. 9 according to various embodiments described herein.

FIGS. 9 and 10 show plan and perspective views, respectively, of a conductive magnetic coupling system 900 that utilizes a number of parallel electrical conductors 902 encompassed with a flexible insulator 904. The flexible insulator 904 acts as a flexible "track" similar to the track system 106 described above. The flexible insulator 904 is made from a flexible material that provides at least a partially impermeable fluid barrier to the parallel electrical conductors 902 for weatherproofing. Doing so allows for the conductive magnetic coupling system 900 to be suitable for outdoor applications, such as lighting on or around a porch, deck, pool deck, or landscaping. The conductive magnetic coupling system 900 allows for any number of luminary modules such as LED arrays 906, or any other types of solid state luminary or other power consumption devices 202, to be magnetically attached to the flexible track at any desired location. To provide an electrical and/or data signal to an attached power consumption device 202, the device is against the track such that penetration devices on a rear side of the power consumption device 202 penetrate the flexible insulator 904 and contact the parallel electrical conductors 902 to provide a conductive path for the electrical and/or data signals.

According to this embodiment, the power consumption device 202 described above is implemented as one or more LED arrays 906 that may be magnetically connected and electrically coupled to the parallel electrical conductors 902. The LED arrays 906 may include any number of LED assemblies 207 arranged in any desired configuration. It should be understood that with any of the embodiments presented herein, the power consumption device 202 may include any number of LED assemblies 207 arranged in any configuration, including but not limited to a single LED assembly 207, a linear strip of LED assemblies 207, one or more groupings of LED assemblies 207, or a large panel of LED assemblies 207. In this manner, LED light "bulbs" may be created that replicate the size and shape of conventional incandescent and fluorescent bulbs. In the implementation shown in FIGS. 9-11B, the LED arrays 906 include a shaped surface 908 that is shaped to nest with the complimentarily shaped surface 910 of the flexible insulator 904. The shaped surfaces 908 and 910 include channels that are shaped correspondingly with the cylindrical shape of the parallel electrical conductors 902.

Looking at FIGS. 11A and 11B, the power distribution coupling mechanism 208 and the power receiving coupling mechanism 204 of the conductive magnetic coupling system 900 will be described in further detail. As discussed above, the power distribution coupling mechanism 208 includes the parallel electrical conductors 902. It should be appreciated that the conductive magnetic coupling system 900 may include two parallel electrical conductors 902, three parallel electrical conductors 902, or any number of parallel electrical conductors 902 according to the desired power and/or control signals utilized within the conductive magnetic coupling system 900. The parallel electrical conductors 902 may include steel cable or any conductive cable. The parallel electrical conductors 902 may be coated, such as a steel cable coated with copper, or a copper cable coated with steel. The precise materials and properties of the parallel electrical conductors 902 can be modified according to the design criteria of the specific application for the conductive magnetic coupling system 900.

Figure 11A:
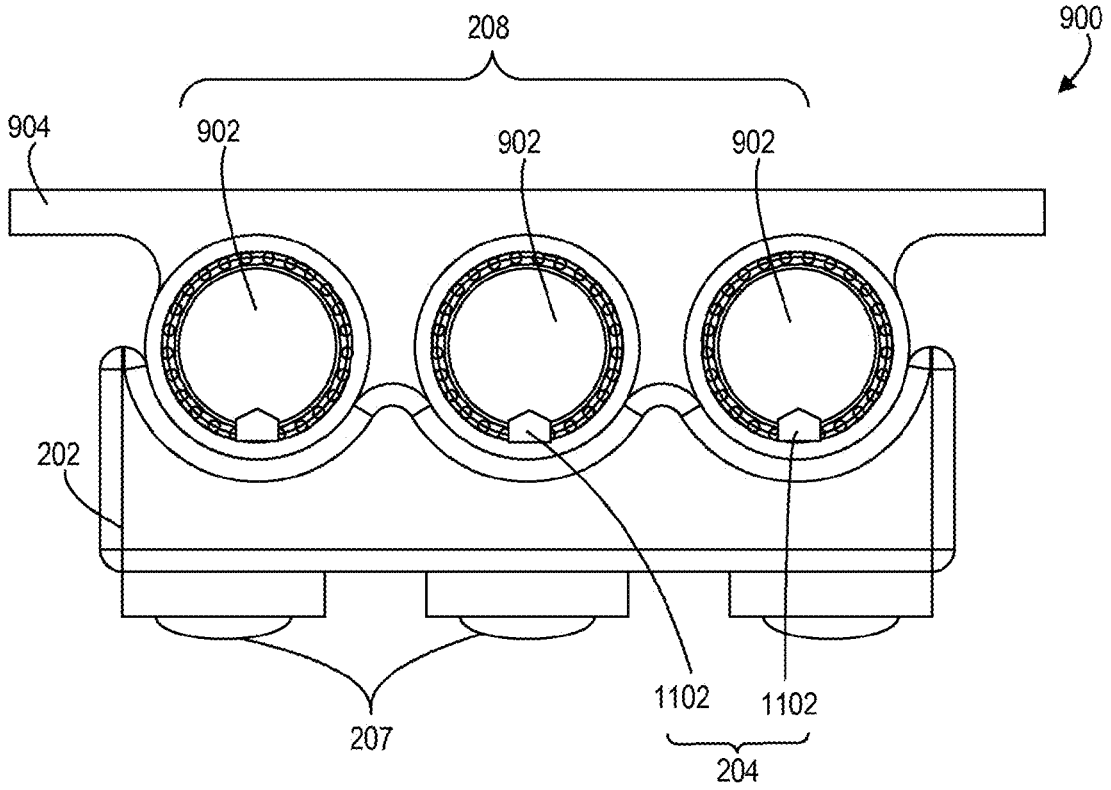
FIG. 11A is a cross-sectional view of a power consumption component coupled to a power supply component showing a number of insulator penetration devices penetrating the flexible insulator and contacting the parallel electrical conductors according to various embodiments described herein.
Figure 11B:
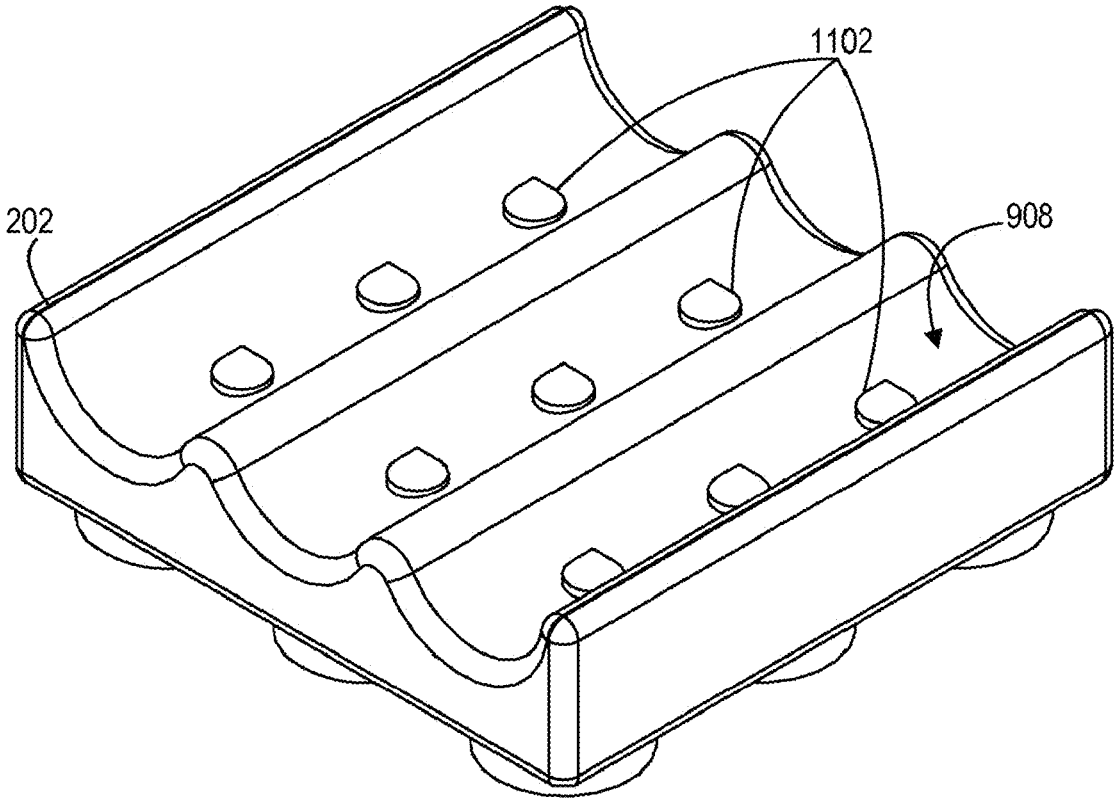
FIG. 11B is a perspective view of the bottom side of the power consumption component of FIG. 11A showing the insulator penetration devices according to various embodiments described herein.

As seen in FIGS. 11A and 11B, the power consumption device 202, or the LED array 906 according to the illustrated implementation, includes a number of insulator penetration devices 1102, which operate as the power receiving coupling mechanism 204. The insulator penetration devices 1102 may be conductive pins that are configured to transport electrical and/or data signals to the LED assemblies 207 from the parallel electrical conductors 902. In order to create a conductive path for the electrical and/or data signals, the insulator penetration devices 1102 are pressed through an outer surface of the flexible insulator 904 and into the parallel electrical conductors 902. The flexible insulator 904 should be a material having characteristics that allow it to provide an impermeability from fluids to protect the parallel electrical conductors 902 from the elements, allow for penetration by the insulator penetration devices 1102 with minimal effort, and sufficiently resilient to deform back into place in order to fill the holes in the flexible insulator 904 created by the penetration devices 1102 when the LED arrays 906 are pulled out for relocation or replacement. An example would be a flexible insulator 904 created from a suitable rubber compound.

To hold the LED arrays 906 in place, either before or after the installation of the insulator penetration devices 1102, magnets may be used to pull the LED arrays 906 toward the parallel electrical conductors 902. According to one implementation, the insulator penetration devices 1102 are conductive magnets similar to the conductive magnets 206 described above. According to another implementation, magnets are incorporated into the power consumption device 202 separately from the insulator penetration devices 1102.

Figure 12A:
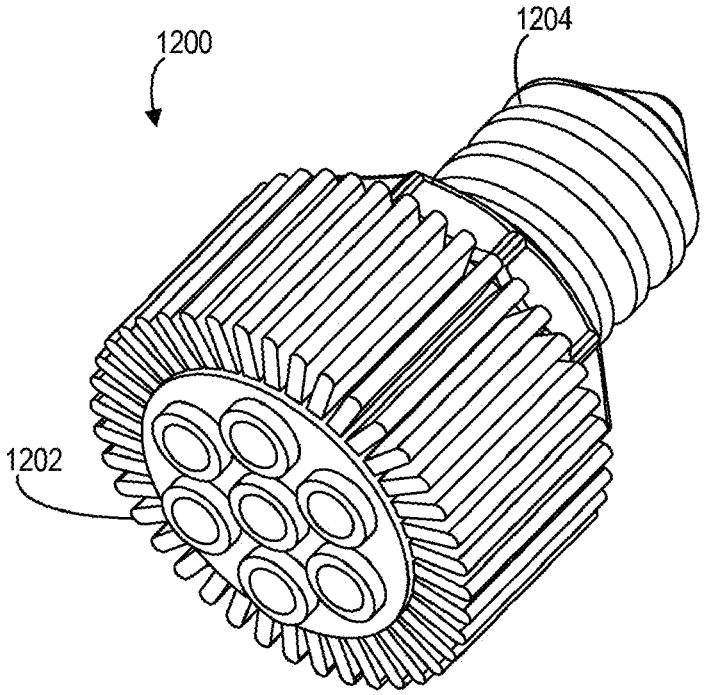
FIGS. 12A-12C are perspective views of a conductive magnetic coupling system for coupling a power consumption component to an Edison screw base component according to various embodiments described herein.
Figure 12B:
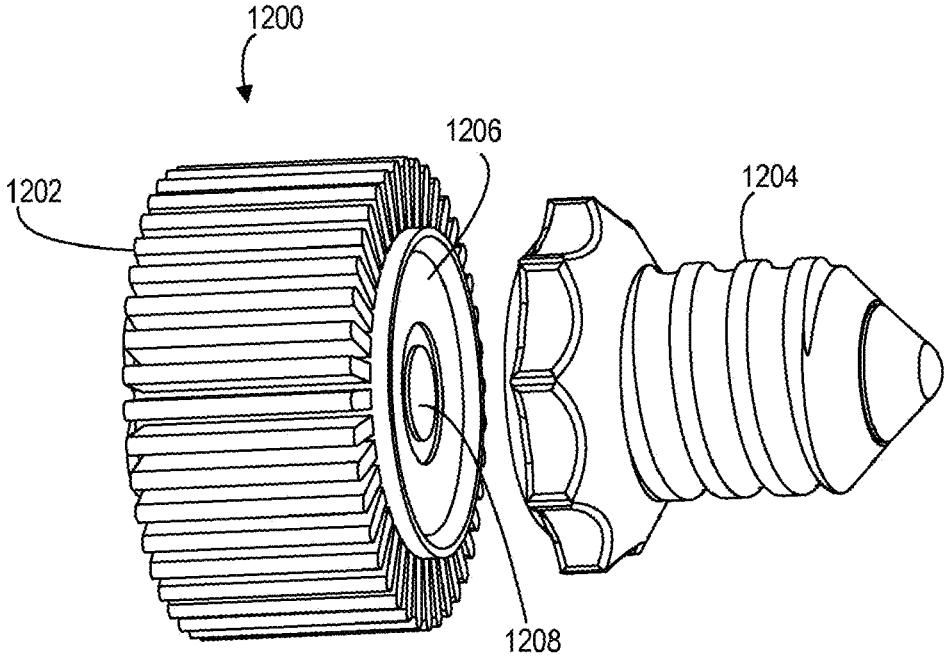
Figure 12C:
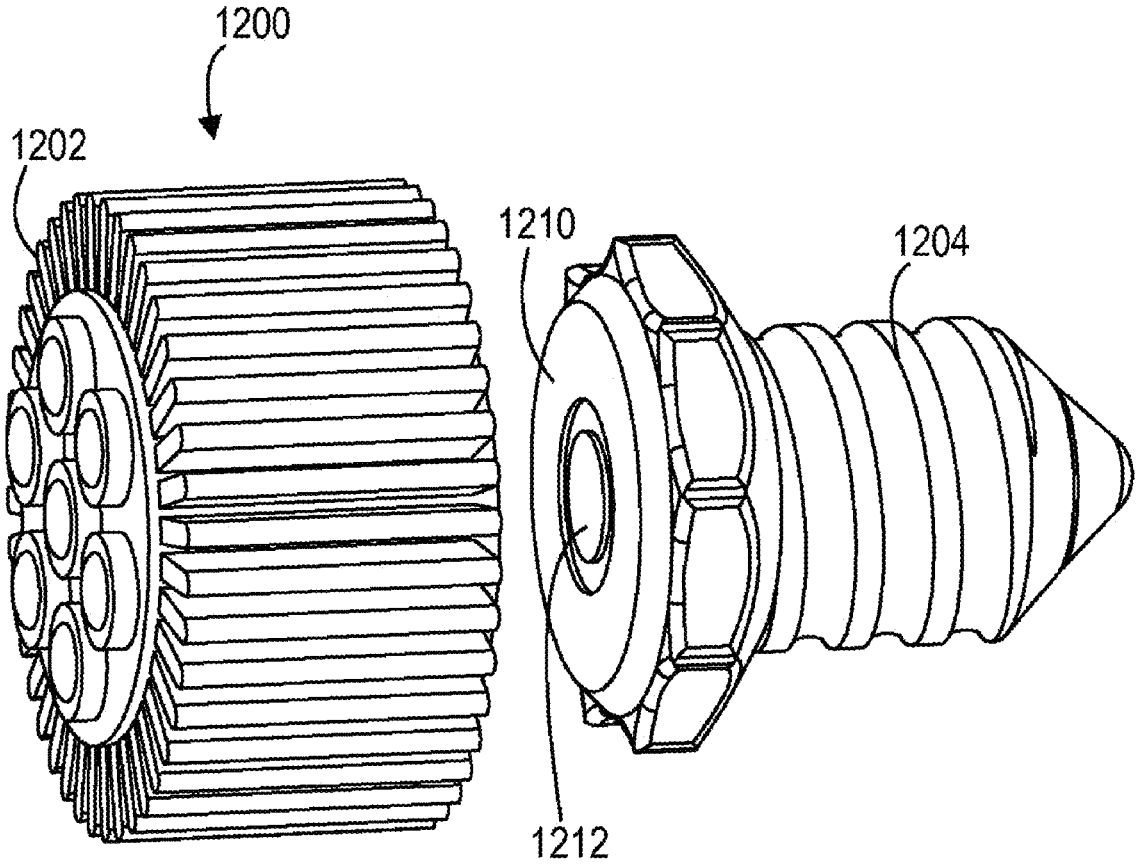

Turning to FIGS. 12A-12C, a conductive magnetic coupling system 1200 will be described in which the power consumption component 104 is implemented as an LED bulb array 1202 and the power supply component 102 is implemented as an Edison screw base component 1204. In this configuration, the Edison screw base component 1204 may include a power supply, and any type of communications and control circuitry. The power receiving coupling mechanism 204 is implemented as an outer ring receiving magnet 1206 and an inner ring receiving magnet 1208, equivalent to the two conductive magnets 206A and 206B described above with respect to the conductive magnetic coupling system 100 above. Similarly, the power distribution coupling mechanism 208 is implemented as an outer ring distribution magnet 1210 and an inner ring distribution magnet 1212, equivalent to the two tracks 210A and 210B described above. All of the concepts and features described above with respect to the conductive magnets 206 and tracks 210 apply to the outer and inner receiving magnets 1206 and 1208 and the outer and inner distribution magnets 1210 and 1212. Additional features of an LED illumination system according to the configuration shown in FIGS. 12A-12C are described in copending application Ser. No. 12/933,588 entitled "Conductive Magnetic Coupling System," Ser. No. 12/408,503 entitled "Managing SSL Fixtures over PLC Networks," Ser. No. 12/408,463 entitled "Illumination Device and Fixture," and Ser. No. 12/408,499 entitled "Energy Management System," which have been incorporated by reference herein in their entirety.

In addition to the embodiments of the invention described above with reference to FIGS. 1-12C, additional embodiments of the invention may be directed to a track lighting system and/or portable light modules for use apart from the track system. The systems and methods described herein with reference to FIGS. 13A-20B may provide several advantages including the ability to provide light during a power outage or emergency situation, customize the light color or distribution of the track lighting module, allow for portable use of the track lighting module, etc. Such utilization of the track lighting system and portable modules described herein provides additional functionality as compared to a traditional track lighting system. Other advantages associated with various embodiments of the invention will be apparent to one of ordinary skill in the art from the included figures and their accompanying descriptions below. The embodiments described below with reference to FIGS. 13A-20B may further incorporate features shown in the embodiments of FIGS. 1-12C not shown or described in FIGS. 13A-20B.

Figure 13A:
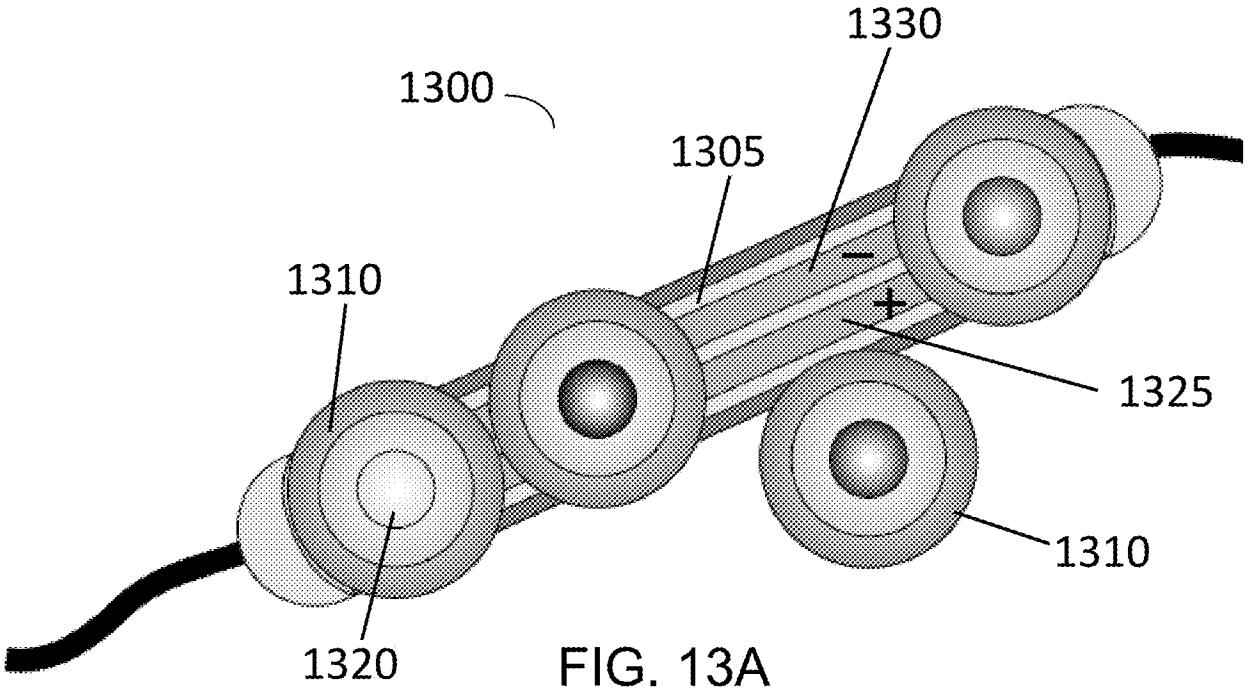
FIG. 13A illustrates a track lighting system with an electrified track and circular shaped light modules in accordance with an example embodiment of the invention.
Figure 13B:
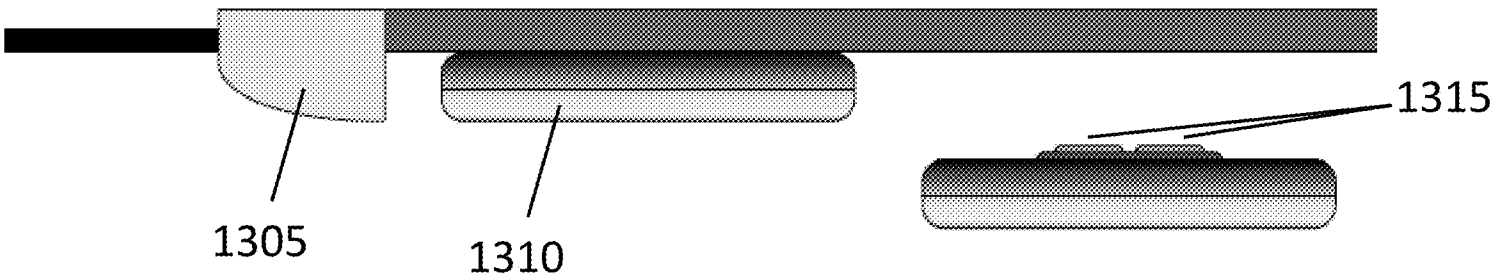
FIG. 13B is a side view of the track lighting system shown in FIG. 13A in accordance with an example embodiment of the invention.

FIG. 13A illustrates a track lighting system 1300 with an electrified track 1305 and circular-shaped (or "puck-shaped") light modules 1310 in accordance with an example embodiment of the invention. FIG. 13B is a side view of the track lighting system 1300 shown in FIG. 13A in accordance with an example embodiment of the invention. As shown in the example embodiments of FIGS. 13A and 13B, magnetic contacts 1315 are provided on the back side of the puck-shaped light modules 1310. The two magnetic contacts 1315 provide both a mechanical connection between the track 1305 and the puck-shaped light modules 1310 and also provide electrical connection to power (and/or a pathway to communicate with) the light elements (e.g., light emitting diode "LED" light sources) of the puck-shaped light modules 1310. As described above with reference to FIGS. 3-5, the magnetic contacts 1315 may be made of a magnetic material that is electrically conductive, or to increase their conductivity, the magnetic contacts 1315 may be treated with a conductive material, coated with a conductive material, or placed adjacent a conductive material (e.g. a fastener, pin) to allow for better electrical connection between the track and the light module(s) 1310. The electrical connection occurs through the magnetic contacts 1315 by having a positive and negative terminal associated with each of the respective magnets in the pair of magnetic contacts 1315 and a positive and negative polarized electrified track 1305. One example embodiment of the invention includes a track system 1305 that has a positive rail 1325 and a negative rail 1330 running along the track housing (allowing the light module to slide along the track), as shown in FIG. 13A. In an alternative embodiment, the positive and negative electrical contacts incorporated into the track 1305 can be located in one location or several locations along the track housing as long as the magnetic contacts 1315 on the light module 1310 can connect to the contacts on the track 1305. The front of the puck-shaped light modules 1310 each contain a light emitting aperture (or window) 1320. While FIGS. 13A and 13B show a linear track system 1305, alternative embodiments may allow for a variety of track shapes (e.g., the circular configuration in FIG. 12, etc.) and sizes including just having a small track (or plate) sized for allowing only one light module 1310 to be able to electrically connect to the positive rail (or contact) 1325 and a negative rail (or contact) 1330 of the track. Further, the track (or plate) containing the rails (or contacts) 1325 and 1330 may be integrated into a ceiling, wall, light fixture housing, or light fixture heat sink, or the like. In addition to the magnetic contacts 1315 providing electrical connection to the track, embodiments of the invention may include reinforcing mechanical fasteners (e.g., clips, springs, screws, notches, protrusions, or the like) to provide additional support for the light module 1310 to connect to the track system 1305 and/or to provide alignment features to ensure appropriate alignment or spacing of the light module(s) 1310 when engaged with the track system 1305.

Figure 14A:
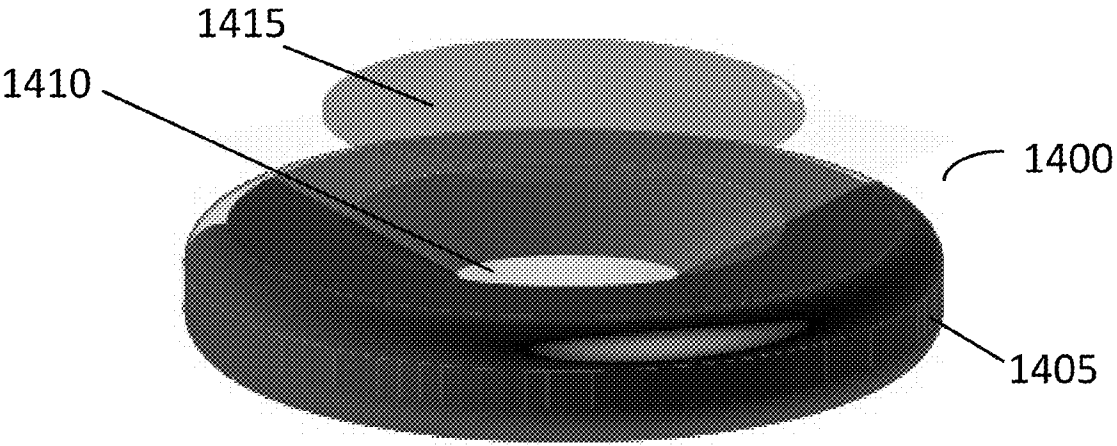
FIG. 14A illustrates a circular shaped module in accordance with an example embodiment of the invention.

FIG. 14A illustrates a puck-shaped module 1400 in accordance with an example embodiment of the invention. As shown in the example embodiment of FIG. 14A, the puck shaped module 1400 has a puck-shaped housing 1405 that houses a light source, a light emitting aperture (or window) 1410, and a lens 1415. In an example embodiment of the invention, the lens 1415 may contain (or be shaped or manufactured to include) one or more refractive and/or reflective optical elements (e.g., refractors, reflectors, prisms, diffusers, or combination thereof, etc.) to alter the distribution of light emitted from the module 1400 through the light emitting aperture 1410. For instance, the beam spread may be altered, or in some embodiments of the invention using LED light sources, individual optical elements corresponding to individual LED units (e.g., individual LED chips/packages) may be incorporated into the light emitting aperture 1410 to adjust the light emitted by each individual LED chip or LED package making up the LED source of the light module 1400.

Figure 14B:
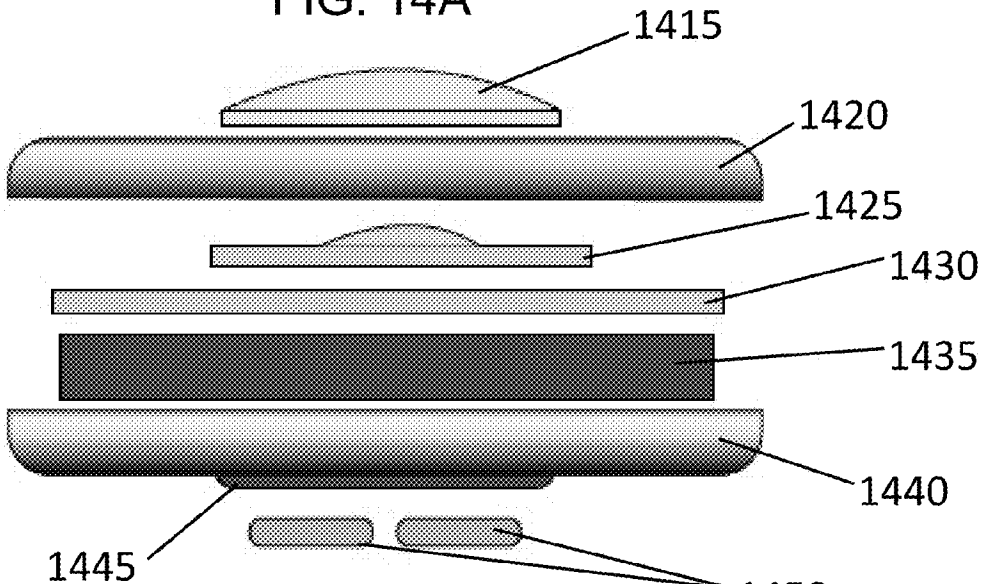
FIG. 14B is an exploded view of the components of the circular shaped module shown in FIG. 14A in accordance with an example embodiment of the invention.

FIG. 14B is an exploded view of the components of the puck-shaped module 1400 shown in FIG. 14A in accordance with an example embodiment of the invention. As shown in the example embodiment of FIG. 14B, the puck-shaped module may include a lens 1415, an upper housing 1420, a light source 1425 (e.g., an LED chip, LED package, or alternatively, an organic light emitting diode "OLED" layer), a substrate for the light source 1430 (e.g., PCB board or other circuit board, etc.), a power supply component 1435 (e.g., drive electronics for converting and/or supplying power to the light source (also known as a "driver"), and optionally an energy storage component such as a battery or electric double-layer capacitor (EDLC) or "supercapacitor."), a lower housing 1440, a mounting plate 1445, and magnets 1450. In alternative embodiments of the invention, the light module 1400 may include a heat sink element (e.g., lower housing, or plate integral to the module and in thermal contact with the light source 1425 and/or module power supply component 1435) that is in thermal communication with the track when the light module 1400 is engaged with the track to allow for thermal transfer from the module to the track.

As shown in FIG. 14B, the upper and lower housings 1420 and 1440 house the components shown with the exception of the mounting plate 1445, which is used to connect the magnets 1450 to the lower housing 1440. In one example embodiment, the magnets 1450 or portions of the mounting plate (or separate conductive pieces) extend through the bottom of the housing 1440 and provide electrical contact to the power supply component 1435. Thus, when the magnets 1450 are connected to an electrified track system, the magnets 1450 route electrical power to the power supply component 1435 which can be used to drive the light source 1425 through the use of the driver and/or the electrical power can be used to charge the energy storage component if one is present. In some embodiments of the invention, communication information can be provided via the electrical input from the track to the power supply component 1440 via the magnets 1450 through the use of varying the duty cycle (or varying another characteristic of the input such as amplitude or frequency) of the electrical input signal or through the inclusion of a power line carrier (PLC) modulated signal than can be deciphered and/or generated by a communication module contained in the power supply component 1435. Alternatively, the communication module for the LED system may employ radio frequency (RF) communication capabilities to communicate with the LED module(s). Such communication means utilizing the power supplied to the module 1400 can allow for one-way communication from the track to the module, such as dimming the light source 1425 via varying the duty cycle, or allow for two-way communication via PLC communication (or RF communication), which can allow for digitally altering the driver characteristics of the power supply component 1435, authenticating the module 1400 with the track system, feedback information on the light source 1425 operating characteristics or additional sensor capabilities for "smart" control of the module in the track system (discussed further below as well as in co-pending U.S. patent application Ser. No. 12/933,588 titled "Conductive Magnetic Coupling System"; Ser. No. 12/408,503 titled "Managing SSL Fixtures over PLC Networks"; Ser. No. 12/408,463 titled "Illumination Device and Fixture"; and Ser. No. 12/408,499 titled "Energy Management System").

In one example embodiment of the invention, the light module 1400 may include switching circuitry in electrical communication with the power supply component 1435, wherein the switching circuitry detects no power being supplied by the magnets 1450 (e.g., in the event no power is being supplied to the magnets by the track system due to the track system being turned off, or in the event of a power outage, failure, or emergency situation) and engages the energy storage element of the power supply component 1435 to supply power to the light source 1425 via the drive electronics (or "driver") included in the power supply component 1435.

Figure 15:
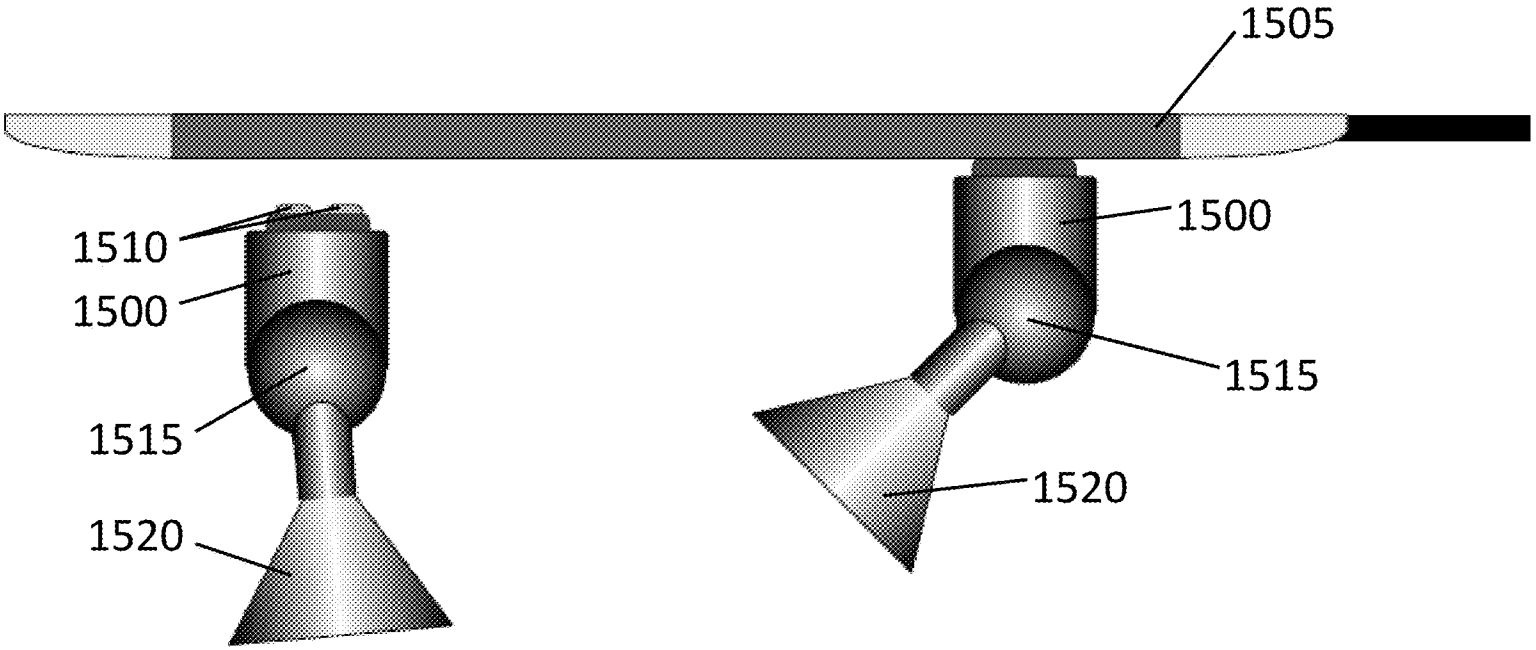
FIG. 15 illustrates a track lighting system with rotatable light modules in accordance with one embodiment of the invention.

FIG. 15 illustrates a track lighting system with rotatable light modules 1500 in accordance with one embodiment of the invention. As shown in the example embodiment of FIG. 15, the rotatable light module 1500 may in the shape of a conical track head, although other form factors for the light module 1500 may be utilized in other embodiments of the invention. The rotatable light module 1500 includes a pivot point 1515 allowing for rotation of the light source and/or rotation of the optical component 1520 (e.g., lens(es), refractor element(s), reflector(s), prisms, diffuser(s), or a combination thereof, etc.) of the rotatable light module 1500. The pivot point may be a hinge, swivel, ball and socket joint, or other mechanical means providing rotation about one or more axis. The rotatable light module 1500 may also be slidable along the track 1505 which can be advantageous for displays or display cases where the track may be installed above the display. Also shown in FIG. 15, the rotatable light module 1500 may be connected to an electrified track system 1505 through magnets 1510.

Figures 16A, 16B, 16C:
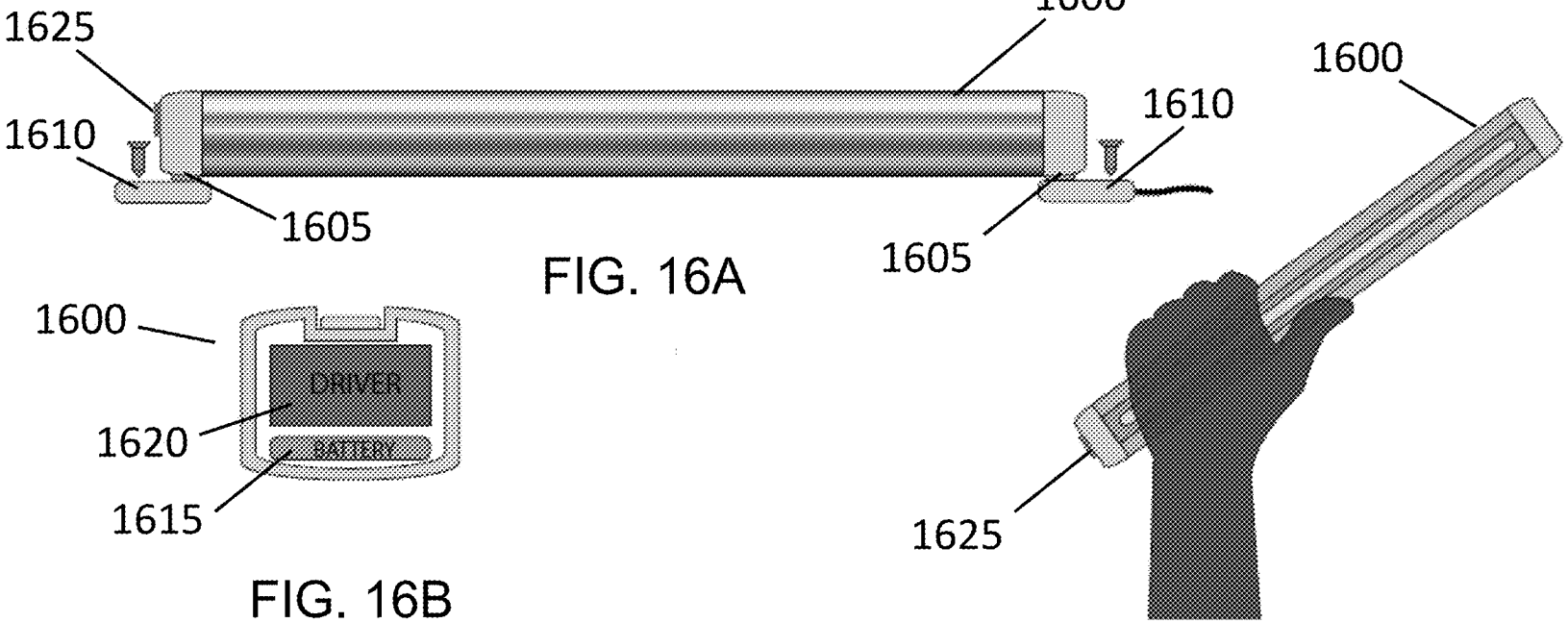
FIGS. 16A and 16B illustrate a portable linear light module in accordance with one embodiment of the invention.
FIG. 16C illustrates the power supply components of the linear light module shown in FIGS. 16A and 16B in accordance with one embodiment of the invention.

FIGS. 16A and 16B illustrate a portable linear light module 1600 in accordance with one example embodiment of the invention. As shown in the example embodiment of FIG. 16A, the linear light module 1600 includes magnets 1605 for providing mechanical and electrical connection between the linear light module 1600 and the charging station 1610, such as a surface mount charging station or surface mount track system. In the example embodiment shown in FIG. 16A, the charging station 1610 may not require a track and have electrical contacts corresponding to at least one of the pair of magnet contacts 1605 at one end of the linear light module 1600. As shown in FIG. 16A, the linear light module 1600 may be magnetically connected at both ends of the linear light module 1600 to one or more docking station, such as the charging station 1610. FIG. 16C illustrates the power supply components (e.g., power storage element 1615 and drive electronics 1620) of the linear light module 1600 shown in FIGS. 16A and 16B in accordance with one embodiment of the invention. The power storage element 1615 may be a battery, electric double-layer capacitor (EDLC) or "supercapacitor," or similar power storage means. The drive electronics 1620 may be an LED driver that converts an AC power signal to a DC output for driving the LEDs or alternatively may be an AC LED driver, a DC-to-DC LED driver, or similar drive electronic components.

As shown in the example embodiment of FIG. 16A, the exterior housing of the linear light module may be touch-sensitive, when mounted, to provide a feedback signal to the drive electronics of the light module to change the drive settings for supplying power to the light source (e.g., LEDs or OLEDs), for instance, turning on or off the light source or dimming the light output of the light source to one or more levels of light output. When removed from the surface mount charge station 1610 for portable use, the capacitive touch feature may be bypassed by an on-off switch 1625 (or alternatively, an internal means such as a circuit detecting a disconnection of the module 1600 from the charging station or track 1610) to prevent variations in light output caused by handling. In one example embodiment of the invention utilizing surface capacitance capabilities may be implemented (alternatively, projected capacitance, mutual capacitance, and/or self capacitance configurations may be implemented), the housing of the light module may include a conductive layer. A voltage may be applied to the conductive layer creating in an electrostatic field, such that when a finger (or other conductor) touches the housing a capacitance level may be detected by a controller. One advantage of the surface capacitance functionality is that it is durable and has no moving parts.

Figures 17A, 17B, 17C, 17D, 17E:
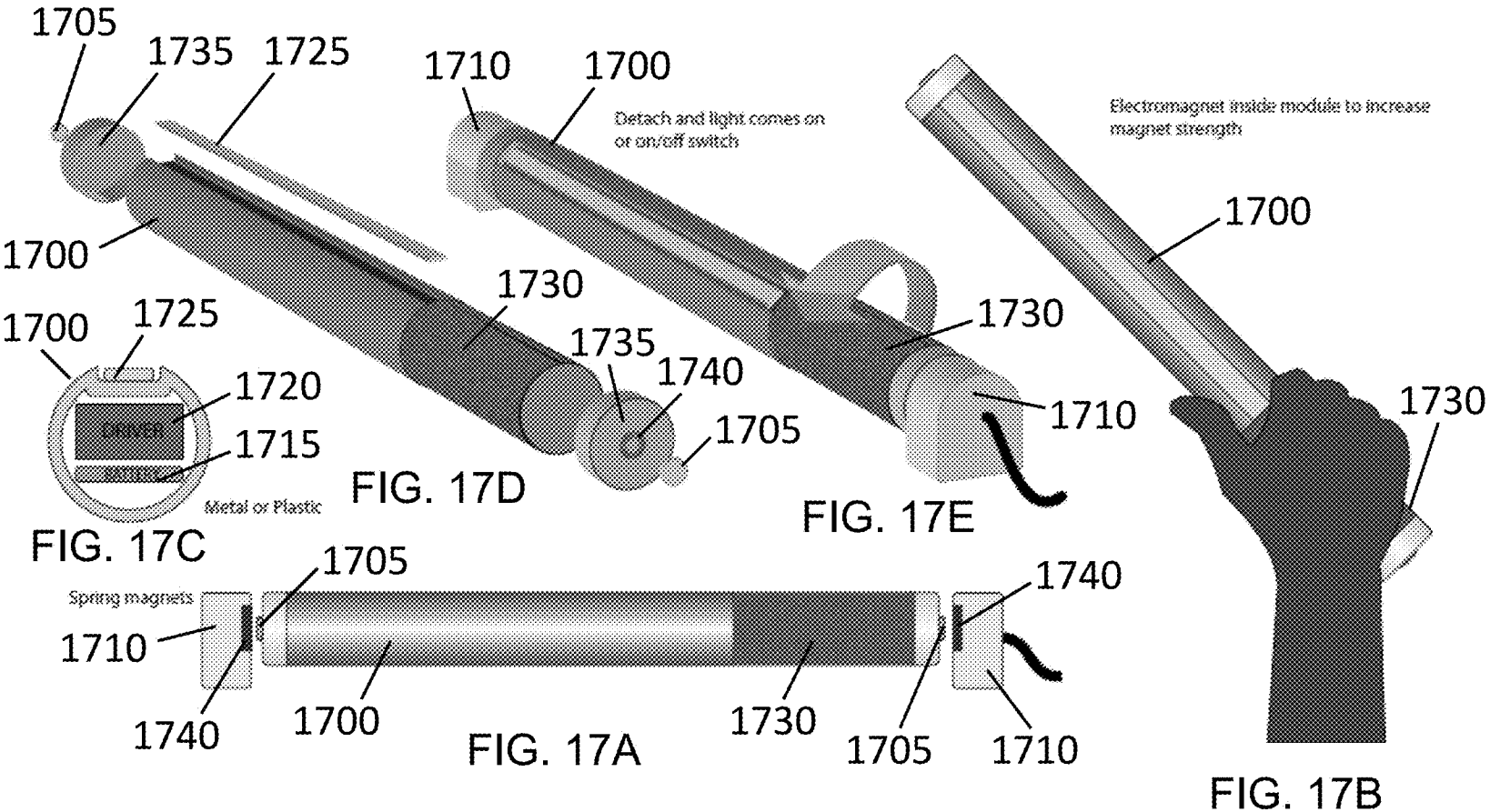
FIGS. 17A and 17B illustrate a linear light module in accordance with another embodiment of the invention.
FIGS. 17C and 17D illustrate the components of the linear light module shown in FIGS. 17A and 17B in accordance with one embodiment of the invention.
FIG. 17E illustrates operation of the portable light module in accordance with one embodiment of the invention.

FIGS. 17A and 17B illustrate a linear light module 1700 for use in accordance with another example embodiment of the invention. As shown in the example embodiment of FIG. 17A, the linear light module 1700 includes magnets 1705 on the sides of the linear light module 1700 for connecting to the charging station 1710. In the example embodiment of FIG. 17A, only one side of the charging station 1710 is required to be electrified to power up the linear light module so long as a pair of magnets is include on the same end of the light module and the one corresponding charge station component has both positive and negative electrical contacts that correspond to the pair of magnets. In an alternative embodiment of the invention (shown in FIG. 17A), a magnet may be located on each end of the linear light module and have corresponding electrical contacts (i.e., one positive polarity and one negative polarity) on each charging station component.

FIGS. 17C and 17D illustrate the components of the linear light module shown in FIGS. 17A and 17B in accordance with one embodiment of the invention. As shown in the example embodiment of FIG. 17C, the linear light module 1700 includes power supply components (e.g., power storage element 1715 and drive electronics 1720) of the linear light module 1700 shown in FIGS. 17A and 17B. The power storage element 1715 may be a battery, electric double-layer capacitor (EDLC) or "supercapacitor," or similar power storage means. The drive electronics 1720 may be an LED driver that converts an AC power signal to a DC output for driving the LEDs or alternatively may be an AC LED driver, a DC-to-DC LED driver, or similar drive electronic components.

As shown in the example embodiment of FIG. 17D, the light module 1700 may further include a light source 1725 (e.g., LED or OLED source), handle portion 1730, end caps 1735, and magnets 1705. In one example embodiment, the magnets 1705, or separate conductive pieces, extend through the end cap 1735 and provide electrical contact to the power supply components 1715 and 1720. Thus, when the magnets 1705 are connected to one or more charging station components, the magnets 1705 route electrical power to the power supply components 1715 and 1720, which can be used to drive the light source 1725 through the use of the drive electronics 1720 (or "driver") and/or the electrical power can be used to charge the energy storage component 1715 if one is present.

FIG. 17E illustrates the operation of the portable light module in accordance with one example embodiment of the invention. As shown in the example embodiment of FIG. 17E, the handle portion 1730 may provide on, off switching or dimming capabilities by twisting the handle portion 1730 from one position to another position(s) to engage or disengage the drive electronics and/or alter a potentiometer (or switching electronics) connected to the drive electronics to alter the power provided to the module light source to change an operating characteristic of the light source (e.g., dimming the light output of the light source, varying the color temperature of the light output from the light source, etc.).

As shown in the example embodiment of FIGS. 17A and 17D, an inductive element 1740 (e.g., an inductive winding or windings) may be included on the interior or the exterior of the light module 1700, for example, in or connected to the end cap 1735, and the interior or exterior of the charge station or track 1710 that when electrified creates an electromagnetic field between the linear light module 1700 and the charging station 1710 (or alternatively the track system connected to the light module) to provide a stronger mechanical (i.e., magnetic) connection between the light module 1700 and the charging station 1710 (or track system).

FIGS. 18A and 18B illustrate a track lighting system 1800 with a portable light module 1805 and detachable power supply 1810 in accordance with one embodiment of the invention. As shown in the example embodiment of FIG. 18A, the portable light module 1805 includes magnets 1815 for connecting to the track system 1800 as well as electrical contacts 1825 for connecting with a detachable power supply 1810. One advantage of a detachable power supply 1810 is the avoidance of the need for two power supplies—one for portable use of the module 1805 and another for use when the module 1805 is connected to the track system 1800. Another advantage is that it can be less expensive to create replacement or alternative light modules for use with the track system 1800 since replacement or alternative light modules would not need to have a power supply incorporated. Rather, they could be designed to be powered off of the detachable power supply 1810.

In the example embodiment shown in FIG. 18B, a mechanical connection 1835 (i.e., a snap-fit or click connection, or twist and lock feature, or similar mechanical connection method) may be provided for mechanically and electrically connecting the portable light module 1805 and the detachable power supply 1810 for portable use of the light module 1805 away from the track system 1800. In an example embodiment of the invention, the detachable power supply 1810 may include an LED driver (for providing the DC power to the LED light sources of the portable module) as well as a power storage element such as a battery or capacitor, such as a fast charging electric double-layer capacitor (EDLC) or "supercapacitor." As shown in FIG. 18A, the detachable power supply 1810 may also include magnets 1820 for connecting to the track system 1800. Power from the track system 1800 may be supplied through the magnets 1820 to allow the power storage component of the detachable power supply 1810 to be charged.

FIG. 18C is a top view of the portable light module 1805 shown in FIGS. 18A and 18B in accordance with one example embodiment of the invention. As shown in the example embodiment of FIG. 18C, a sensor 1830 may be incorporated into the light module 1805 (or alternatively the detachable power supply 1810). The sensor may provide additional operational functionality such as a photosensor to detect the light level in the surrounding area to provide feedback information to circuitry (e.g., analog switching circuitry, or processor form digital signaling) in communication with the driver to direct the driver when and how much to drive the LED light sources in the light module 1805. In an alternative embodiment, the sensor 1830 may be an occupancy sensor that detects movement (i.e., through infrared, ultrasonic, or other detection means) to provide feedback information to circuitry (e.g., analog switching circuitry, or processor form digital signaling) in communication with the driver to direct the driver to supply power to the LED light sources in the light module 1805 when movement is detected. In yet another embodiment of the invention, the sensor may be an indicator light providing an indication of the charging level (i.e., lights indicating amount of charge left in the power storage element) or charging status (i.e., lights indicating "currently charging," "full charged," etc.) of the detachable power supply 1810.

Figure 19A:
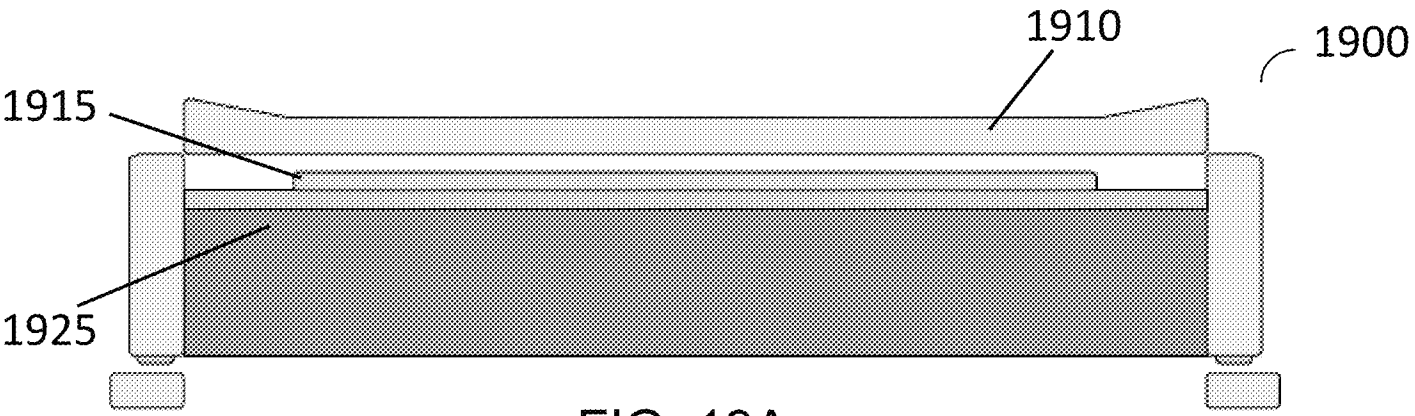
FIGS. 19A and 19B illustrate a light module with interchangeable cover plates in accordance with one embodiment of the invention.
Figure 19B:
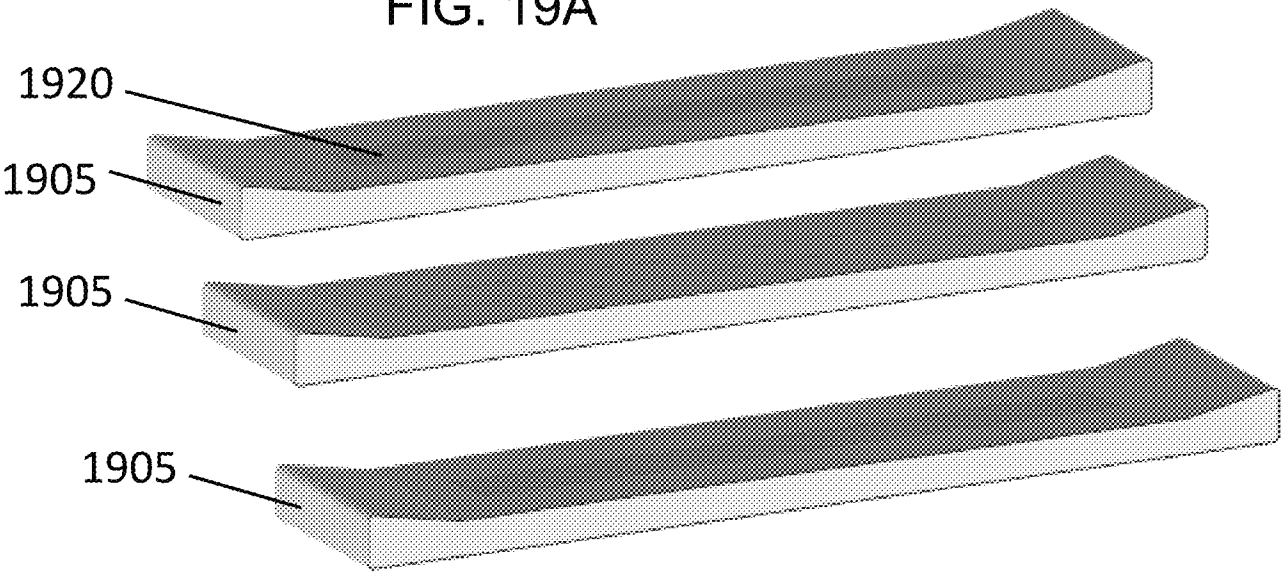

FIGS. 19A and 19B illustrate a light module 1900 with interchangeable cover plates 1905 in accordance with one example embodiment of the invention. As shown in the example embodiment of FIG. 19A, the light module 1900 includes a cover plate 1910 that contains a light emitting aperture 1920 and fits over the light source (e.g., LED(s)) of the light module 1900. The cover plate 1910 may be removably coupled to the light module housing 1925 via a mechanical fastener (e.g., screws, spring clips, magnets, and/or other mechanical fasteners), or may be shaped to allow for a snap-fit connection with the light module housing 1925.

As shown in FIG. 19B, a variety of interchangeable cover plates 1905 may be provided to allow for modification to the light module 1900. For instance, the light emitting aperture 1920 of an interchangeable cover plate 1905 may alter the color temperature of the light emitted by the module 1900. This may be done by tinting the light emitting aperture 1920 to a particular color, or in an LED based embodiment of the invention, the light emitting aperture 1920 may contain phosphor or nanophosphor (or "quantum dot") material, or a combination of both to alter the color output of the LED light source 1915 of the module 1900. In another embodiment of the invention, the aperture 1920 of the interchangeable cover plate 1905 may contain refractive and/or reflective optical elements (e.g., lenses, refractor elements, reflectors, prisms, diffusers, or combination thereof, etc.) to alter the distribution of light emitted from the module 1900 through the aperture 1920. For instance, the beam spread may be altered, or in some embodiments of the invention using LED light sources, individual optical elements corresponding to individual LED sources 1915 may be incorporated into the aperture 1920 to adjust the light emitted by each individual LEDs making up the LED source 1915 of the light module 1900.

Figure 20A:
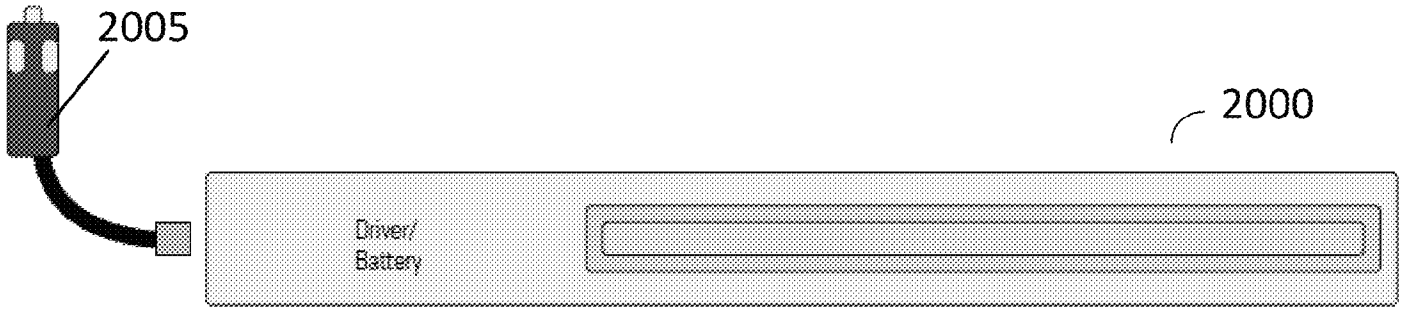
FIG. 20A is a top view of a portable light module with an alternative power supply connection in accordance with one embodiment of the invention.
Figure 20B:
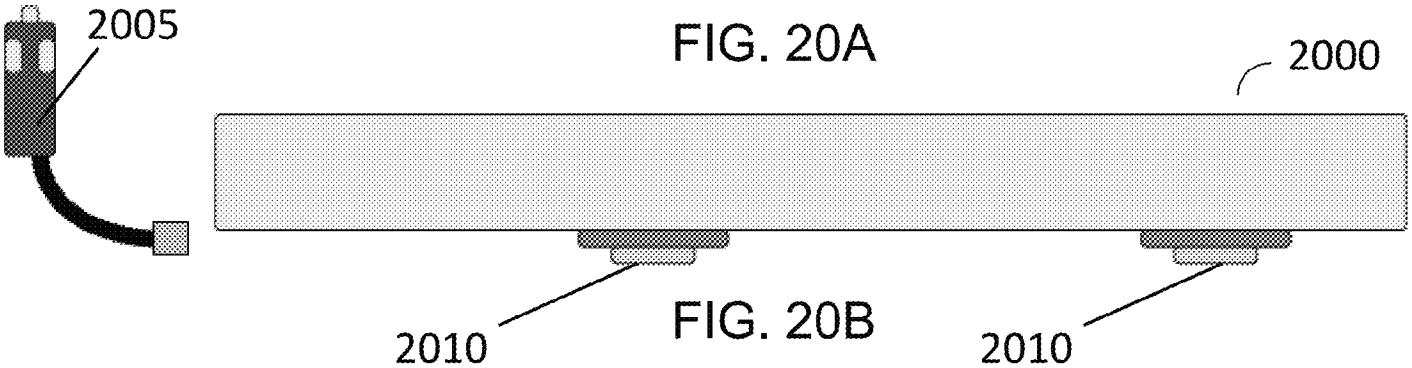
FIG. 20B is a side view of the portable light module of FIG. 20A in accordance with one embodiment of the invention.
Figure 20C:
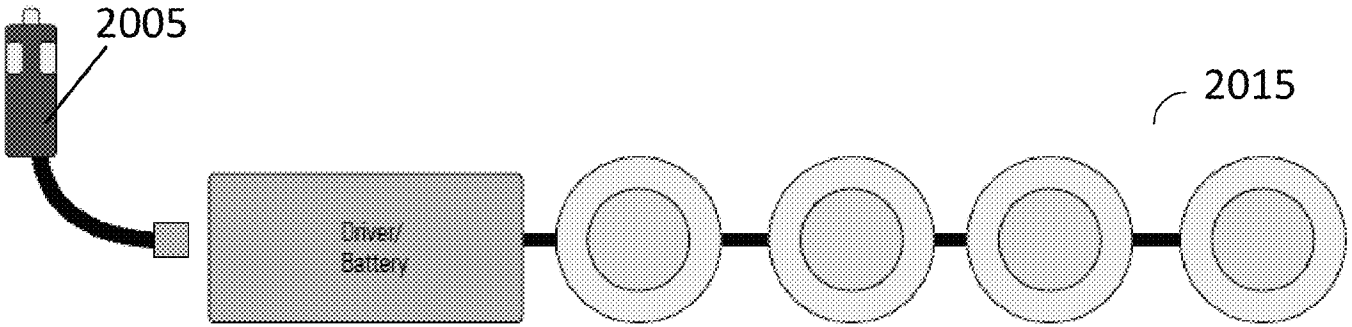
FIG. 20C is a top view of a string of portable light modules with an alternative power supply connection in accordance with one embodiment of the invention.

FIG. 20A is a top view of a portable light module 2000 with an alternative power supply connection in accordance with one example embodiment of the invention. As shown in the example embodiment of FIG. 20A, the portable light module 2000 includes a separate power supply connector 2005, such as a car cigarette lighter receptacle connector (as shown). Alternatively, other power supply connection methods may be incorporated, such as a USB cable, or other similar power supply connectors or even a proprietary-shaped connector for the portable light module 2000. This alternative power supply connector 2005 allows recharging of the portable light module 2000 without reconnecting the portable light module 2000 to the track. FIG. 20B is a side view of a portable light module 2000 in accordance with one embodiment of the invention. As shown in FIG. 20B, the magnets 2010 allow for mechanical attachment to the track system as well as provide electrical connection and power supply from the electrified track to the portable light module 2000. FIG. 20C is a top view of a string of portable light modules 2015 with an alternative power supply connection in accordance with one embodiment of the invention.

This invention maybe embodied in many different forms and should not be construed as limited to the embodiments set forth herein; rather, these embodiments are provided so that this disclosure will be thorough and complete, and will fully convey the scope of the invention to those skilled in the art. Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light module comprising:

a module housing containing a light emitting aperture;

a light emitting diode (LED) light source located inside the module housing, wherein the LED light source is aligned with the light emitting aperture;

a driver electrically connected to the LED light source;

a chargeable power supply component electrically connected to the driver;

at least two magnets attached to the exterior of the module housing, wherein at least one magnet is associated with a positive electrical terminal and another magnet is associated with a negative terminal, wherein at least one of the at least two magnets provides electrical power to at least one of the chargeable power supply component or the driver, and wherein the at least one of the at least two magnets provides mechanical connection to a track system, and wherein the light module is positionable along the track system via the at least one of the at least two magnets; and an inductive element for providing an electromagnetic force between the module housing and the track system.

2. The light module of claim 1, wherein the module housing includes a capacitive touch sensor.

3. The light module of claim 1, wherein the LED light source is an organic LED light source.

4. The light module of claim 1, further comprising a power connector for charging the light module without use of the at least one magnet.

5. The light module of claim 1, wherein the chargeable power supply component or the driver is detachably coupled to the light module housing.

6. The light module of claim 5, wherein the chargeable power supply component or the driver that is detachably coupled to the light module housing includes the at least one magnet when detached.

7. The light module of claim 1, further comprising at least one optical element aligned with the light emitting aperture.

8. The light module of claim 7, further comprising a pivot for rotating the light source, light emitting aperture, or the optical element.

9. A light module comprising:

a module housing containing a light emitting aperture, wherein the module housing includes a sensor;

a light emitting diode (LED) light source located inside the module housing, wherein the LED light source is aligned with the light emitting aperture;

a driver electrically connected to the LED light source;

a chargeable power supply component electrically connected to the driver; and at least two magnets attached to the exterior of the module housing, wherein at least one magnet is associated with a positive electrical terminal and another magnet is associated with a negative terminal, wherein at least one of the at least two magnets provides electrical power to at least one of the chargeable power supply component or the driver, and wherein the at least one of the at least two magnets provides mechanical connection to a track system, the light module being positionable along the track system via the at least one of the at least two magnets.

10. The light module of claim 9, wherein the sensor is a capacitive touch sensor.

11. The light module of claim 9, wherein the LED light source is an organic LED light source.

12. The light module of claim 9, further comprising a power connector for charging the light module without use of the at least one magnet.

13. The light module of claim 9, wherein the chargeable power supply component or the driver is detachably coupled to the light module housing.

14. The light module of claim 13, wherein the chargeable power supply component or the driver is detachably coupled to the light module housing and includes the at least one magnet when detached.

15. The light module of claim 9, further comprising at least one optical element aligned with the light emitting aperture.

16. A light module comprising:

a module housing containing a light emitting aperture;

a light emitting diode (LED) light source located inside the module housing, wherein the LED light source is aligned with the light emitting aperture;

a driver electrically connected to the LED light source;

a chargeable power supply component electrically connected to the driver;

at least two magnets attached to the exterior of the module housing, wherein at least one magnet is associated with a positive electrical terminal and another magnet is associated with a negative terminal, wherein at least one of the at least two magnets provides electrical power to at least one of the chargeable power supply component or the driver, and wherein the at least one of the at least two magnets provides mechanical connection to a track system, the light module being positionable along the track system via the at least one of the at least two magnets; and switching circuitry electrically connected to the chargeable power supply component and the driver, wherein the switching circuitry is configured to detect when no power is supplied by the at least one of the at least two magnets and engage the chargeable power supply component to supply power to the driver.

17. The light module of claim 16, further comprising at least one optical element aligned with the light emitting aperture.

18. The light module of claim 17, further comprising a pivot for rotating the light source, light emitting aperture, or the optical element.

19. The light module of claim 16, further comprising a power connector for charging the light module without use of the at least one magnet.

20. The light module of claim 16, wherein the chargeable power supply component or the driver is detachably coupled to the light module housing.

21. The light module of claim 1, wherein the track system is magnetically conductive and provides power to the light module along a length of the track system via the at least one of the at least two magnets.

* * * * *